US011377797B2

(12) United States Patent
Collins et al.

(10) Patent No.: US 11,377,797 B2
(45) Date of Patent: Jul. 5, 2022

(54) WOVEN PAPERMAKING FABRIC HAVING MACHINE AND CROSS-MACHINE ORIENTED TOPOGRAPHY

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/650,068

(22) PCT Filed: Sep. 27, 2018

(86) PCT No.: PCT/US2018/053077
§ 371 (c)(1),
(2) Date: Mar. 24, 2020

(87) PCT Pub. No.: WO2019/067690
PCT Pub. Date: Apr. 4, 2019

(65) Prior Publication Data

US 2020/0291578 A1 Sep. 17, 2020

Related U.S. Application Data

(60) Provisional application No. 62/565,625, filed on Sep. 29, 2017.

(51) Int. Cl.
*D21F 7/08* (2006.01)
*D21F 11/00* (2006.01)
(Continued)

(52) U.S. Cl.
CPC ..... *D21F 7/08* (2013.01); *D21F 11/006* (2013.01); *D21H 27/002* (2013.01); *D21H 27/02* (2013.01)

(58) Field of Classification Search
CPC ..... D21F 1/0036; D21F 5/18; D21F 11/006; D21F 11/14; D21F 7/08; D21F 1/00;
(Continued)

(56) References Cited

U.S. PATENT DOCUMENTS 4,191,609 A 3/1980 Trokhan
5,228,482 A 7/1993 Fleischer
(Continued)

FOREIGN PATENT DOCUMENTS

CN 2885922 Y 4/2007
CN 204000435 U 12/2014
(Continued)

OTHER PUBLICATIONS

Co-pending U.S. Appl. No. 16/650,050, filed Mar. 24, 2020, by Collins et al. for "Twill Woven Papermaking Fabrics."
(Continued)

*Primary Examiner* — Eric Hug
*Assistant Examiner* — Matthew M Eslami
(74) *Attorney, Agent, or Firm* — Kimberly-Clark Worldwide, Inc.

(57) ABSTRACT

Disclosed are woven papermaking fabrics having a textured sheet contacting surface with machine and cross-machine direction topography. The machine direction (MD) topography may be imparted by substantially MD oriented protuberances comprising a warp strand supported by a shute strand. The cross-machine direction (CD) topography may be imparted by substantially CD oriented protuberances comprising a shute strand supported by a warp strand. The CD protuberances may extend continuously in the CD and intersect the MD oriented protuberances to form discrete pockets there between. The pockets may have a variety of shapes and size depending on the MD and CD oriented protuberance. In certain instances the pockets may be rec-
(Continued)

tilinear and have a pocket depth greater than 1.0 mm and a pocket angle greater than 28 degrees.

23 Claims, 23 Drawing Sheets

(51) Int. Cl.
*D21H 27/00* (2006.01)
*D21H 27/02* (2006.01)

(58) Field of Classification Search
CPC .... D21F 1/0027; D03D 13/00; D21H 27/002; D21H 27/02
See application file for complete search history.

(56) References Cited

U.S. PATENT DOCUMENTS

| | | | | |
|---|---|---|---|---|
| 5,240,763 | A | 8/1993 | Wagner et al. | |
| 5,449,026 | A * | 9/1995 | Lee | D21F 1/0036 139/383 A |
| 5,456,293 | A | 10/1995 | Ostermayer et al. | |
| 5,520,225 | A | 5/1996 | Quigley et al. | |
| 5,713,397 | A * | 2/1998 | Quigley | D21F 1/0036 139/383 A |
| 5,832,962 | A | 11/1998 | Kaufman et al. | |
| 6,402,895 | B1 | 6/2002 | Best | |
| 6,660,362 | B1 | 12/2003 | Lindsay et al. | |
| 6,673,202 | B2 | 1/2004 | Burazin et al. | |
| 7,166,189 | B2 | 1/2007 | Burazin et al. | |
| 7,235,156 | B2 | 6/2007 | Baggot | |
| 7,294,229 | B2 | 11/2007 | Hada et al. | |
| 7,300,543 | B2 | 11/2007 | Mullally et al. | |
| 7,611,605 | B2 | 11/2009 | Burazin et al. | |
| 7,611,607 | B2 | 11/2009 | Mullally et al. | |
| 7,726,349 | B2 | 6/2010 | Mullally et al. | |
| 7,935,409 | B2 | 5/2011 | Burazin et al. | |
| 2001/0032712 | A1 | 10/2001 | Friedbauer et al. | |
| 2002/0056536 | A1 * | 5/2002 | Lamb | D21F 11/006 162/100 |
| 2003/0079850 | A1 | 5/2003 | Rougvie | |
| 2003/0084952 | A1 | 5/2003 | Burazin et al. | |
| 2007/0209770 | A1 * | 9/2007 | Barrett | D21F 1/0036 162/358.2 |
| 2008/0110591 | A1 | 5/2008 | Mullally et al. | |
| 2008/0169040 | A1 | 7/2008 | Barrett | |
| 2009/0065166 | A1 * | 3/2009 | Quigley | D21F 11/006 162/348 |
| 2014/0231039 | A1 * | 8/2014 | Patel | D21F 7/12 162/289 |
| 2016/0215451 | A1 | 7/2016 | Uymur et al. | |
| 2017/0211235 | A1 | 7/2017 | Lamb | |

FOREIGN PATENT DOCUMENTS

| | | | |
|---|---|---|---|
| CN | 206438338 | U | 8/2017 |
| WO | 0012817 | A1 | 3/2000 |
| WO | 13023276 | A1 | 2/2013 |
| WO | 20068091 | A1 | 4/2020 |
| WO | 20068092 | A1 | 4/2020 |

OTHER PUBLICATIONS

Co-Pending U.S. Appl. No. 16/650,058, filed Mar. 24, 2020, by Collins et al. for "Woven Papermaking Fabric Including Stablilized Weave Providing Textured Contacting Surface."
Co-Pending U.S. Appl. No. 16/650,065, filed Mar. 24, 2020, by Collins et al. for "Woven Papermaking Fabric Having Converging, Diverging or Merging Topography."

* cited by examiner

WOVEN PAPERMAKING FABRIC HAVING MACHINE AND CROSS-MACHINE ORIENTED TOPOGRAPHY

BACKGROUND OF THE INVENTION

In the manufacturing of tissue products, particularly absorbent tissue products such as bath tissue and facial tissue products, there is a continuing need to improve the physical properties of the tissue and offer a differentiated product appearance. It is generally known that molding a partially dewatered cellulosic web on a topographical papermaking fabric will enhance the finished paper product's physical properties, such as sheet bulk, stretch and softness, and aesthetics. Such molding can be applied by fabrics in a through air dried process, such as the process disclosed in U.S. Pat. No. 5,672,248, or in a wet-pressed tissue manufacturing process, such as that disclosed in U.S. Pat. No. 4,637,859.

Exemplary papermaking fabrics are disclosed in U.S. Pat. Nos. 5,456,293 and 5,520,225, which teach papermaking from interwoven sets of filaments configured to provide a first grouping of co-planar top-surface crossovers of both sets of filaments, and also a predetermined second grouping of recessed sub-top-surface crossovers of both sets of filaments. The top-surface crossovers are arranged in spaced relation to define arrays of cavities or pockets which are disposed in linear arrays. The weave pattern however, is limited in the depth of pockets that may be formed, as well as the steepness of the pocket wall angle and the ability to modify the shapes of the walls independently.

Other woven papermaking fabrics are disclosed in U.S. Pat. No. 6,998,024, which teaches woven papermaking fabrics with substantially continuous machine direction ridges whereby the ridges are made up of multiple warp strands grouped together. The ridges are higher and wider than individual warps. The wide wale ridges have a ridge width of about 0.3 cm or greater and the frequency of occurrence of the ridges in the CD is from about 0.2 to 3 per centimeter. In the examples shown, the shute diameters are both larger than or smaller than the warp diameters but only one shute diameter is utilized.

Still other woven papermaking fabrics are disclosed in U.S. Pat. No. 7,300,543, which teaches fabrics having discontinuous pocket structures with a regular series of distinct, relatively large depressions in the fabric surface surrounded by raised warp or raised shute strands. The most common examples are waffle-like in structure and could be warp dominant, shute dominant, or coplanar. While the pockets are relatively deep, the shapes are limited, particularly in terms of their width in the cross-machine direction.

The prior art woven papermaking fabrics, such as those taught by U.S. Pat. Nos. 5,456,293, 5,520,225, 6,998,024 and 7,300,543, are generally limited to fabrics having evenly distributed pockets and relatively simple geometric patterns. The distribution of the pockets and the complexity of the geometric patterns has been limited by the need to create three-dimensional topography by having engineering unbalanced forces to push warps/wefts out of the fabric plane. Further, having to resort to unbalanced forces to create three-dimensional topography limits the ability to create both machine direction (MD) and cross-machine direction (CD) elements with a relatively high degree of topography. In those instances where the prior art has introduced CD elements having a degree of topography, the element generally results in poor pocket depth or poor vertical direction compression resistance.

SUMMARY

The present inventors have now discovered weave patterns useful in the weaving of papermaking that do not solely rely upon unbalanced forces to push warp elements out of the fabric plane to create woven patterns. As a result, the inventive weave patterns may be adapted to provide a wide range of visually pleasing patterns comprising more complex geometric shapes. Further, the inventive weave patterns may yield both machine direction and cross-machine direction protuberances having upper surface planes that lie above the lowest web contacting surface of the woven fabric. Further, the machine direction and cross-machine direction protuberances may be arranged to provide pockets there between with relatively steep sidewalls and good pocket depth.

The new weave patterns allow single filaments to be placed over fabric support structures and for forces to be applied to the filaments in a controlled fashion, which allows the shape and appearance of the filaments to be modified without destabilizing the entire fabric. For example, the weave pattern may comprise warp filaments woven above corresponding shute filaments to form a substantially machine direction (MD) oriented protuberance that intersects a substantially cross-machine direction (CD) oriented protuberance comprising shute filaments woven above corresponding warp filaments. Weaving fabrics in this manner may result in fabrics having substantially rectilinear pockets having well defined sidewalls with steep angles, smooth bottoms and good depth.

In certain instances the fabrics may be woven such that when the MD oriented protuberance intersects the CD oriented protuberance the warp filament may exert a force on the shute filament forming the CD oriented protuberance. The force may cause the CD oriented protuberance to become distorted and for the resulting pocket to have first and second end walls that are nonlinear. Distortion of the CD oriented protuberances in this manner may be used to create papermaking fabrics having novel patterns that are also capable of producing tissue products having desirable properties.

Accordingly, in one embodiment the present invention provides a woven papermaking fabric comprising: a plurality of substantially machine direction (MD) oriented warp filaments; and a plurality of substantially cross-machine direction (CD) oriented shute filaments, the shute filaments being interwoven with warp filaments to provide a woven fabric having a textured web contacting side and an opposite machine contacting side having a plurality of discrete pockets disposed thereon, wherein each discrete pocket has a pair of opposed end walls and a pair of opposed sidewalls, wherein the opposed end walls comprise at least one shute filament and the sidewalls comprise at least one warp filament.

In another embodiment the present invention provides a woven papermaking fabric comprising a plurality of substantially MD oriented warp filaments; and a plurality of CD oriented shute filaments, the shute filaments being interwoven with warp filaments to provide a textured web contacting side of the woven papermaking fabric and machine contacting side of the woven papermaking fabric; a plurality of discrete rectilinear pockets disposed on the web contacting side of the woven papermaking fabric, each pocket having a pair of opposed end walls and a pair of opposed sidewalls, wherein the opposed end walls comprise a plurality of shute filaments and the sidewalls comprise at least one warp filament. In certain embodiments the pockets may have a pocket depth from about 0.2 to about 1.50 mm and an area from about 100 to about 300 $mm^2$. In particularly preferred embodiments all of the pockets disposed on the web contacting side of the woven fabric are substantially similar in terms of shape, depth and area.

In other embodiments the present invention provides a woven papermaking fabric comprising a plurality of substantially MD oriented warp filaments; and a plurality of substantially CD oriented shute filaments, the shute filaments being interwoven with warp filaments to provide a textured web contacting side of the woven papermaking fabric and machine contacting side of the woven papermaking fabric, wherein the web contacting side comprises: a substantially CD oriented protuberance comprising at least one shute filament woven above a corresponding warp filament, the shute filament having a first proximal end and a first distal end; a first substantially MD oriented protuberance comprising a warp filament extending in a first longitudinal direction and woven above a corresponding shute filament, the first MD oriented protuberance having a first proximal end disposed adjacent to the first proximal end of the at least one shute element, and a second substantially MD oriented protuberance comprising a warp filament extending in a second longitudinal direction opposite that of the first substantially MD oriented protuberance and woven above a corresponding shute filament, the second MD oriented protuberance having a first distal end disposed adjacent to the first distal end of the at least one shute element.

In yet other embodiments the present invention provides a woven papermaking fabric comprising: a plurality of substantially machine direction (MD) oriented warp filaments; and a plurality of substantially cross-machine direction (CD) oriented shute filaments, the shute filaments being interwoven with warp filaments to provide a woven fabric having a textured web contacting side and an opposite machine contacting side having a plurality of discrete rectilinear pockets thereon, the pocket having a first sidewall formed from a substantially CD oriented protuberance comprising at least one shute filament woven above a corresponding warp filament, and a second sidewall formed from a first substantially MD oriented protuberance comprising a warp filament extending in a first longitudinal direction and woven above a corresponding shute filament.

DEFINITIONS

Figure 1:
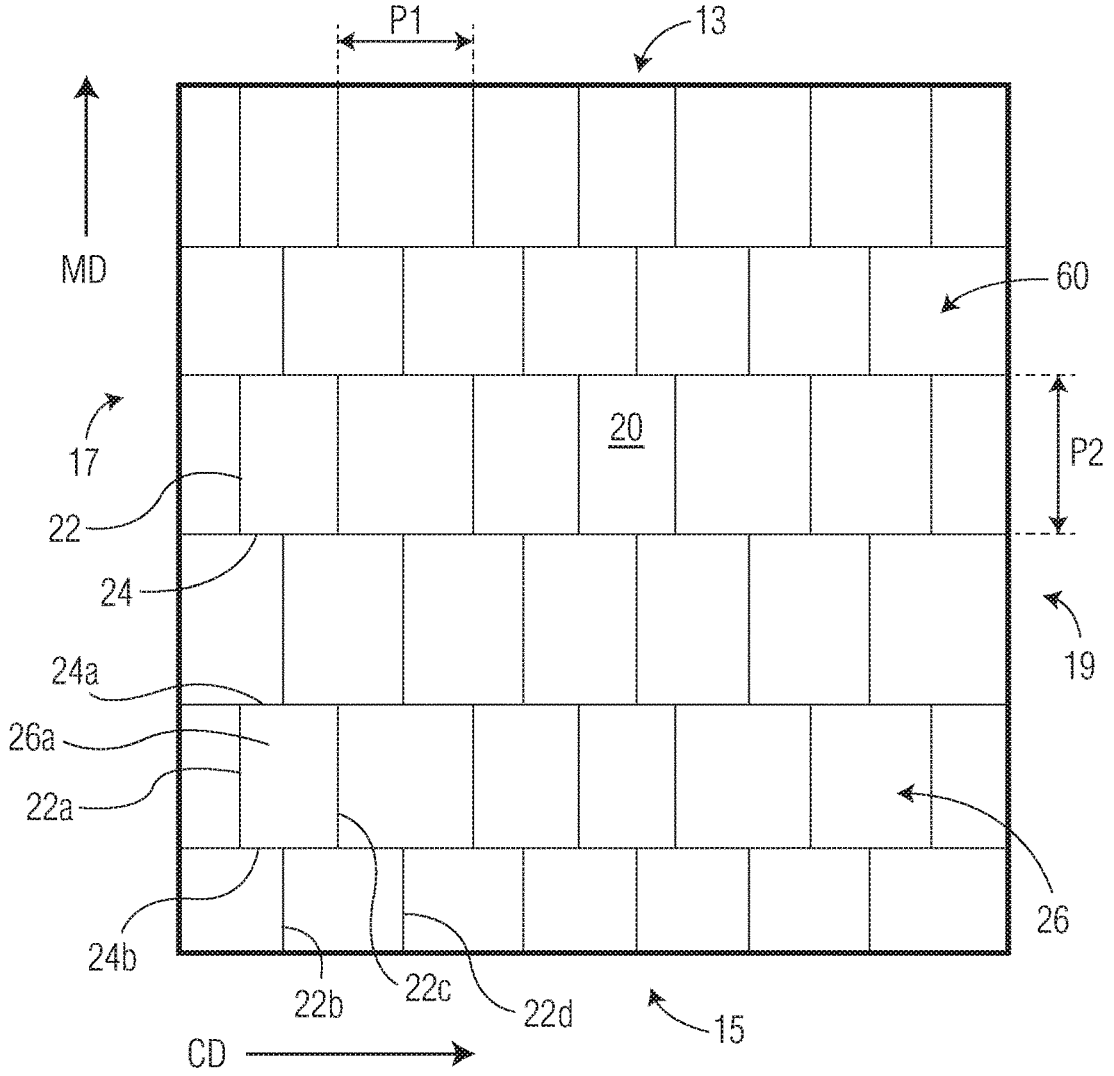
FIG. 1 is a top view of a woven papermaking fabric having a three-dimensional fabric contacting surface according to one embodiment of the present invention.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulosic web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as a molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No.

4,849,054; as a structured fabric adjacent a wet web in a nip as described in U.S. Pat. No. 7,476,293; or as a through-air drying fabric as described in U.S. Pat. Nos. 5,429,686, 6,808,599 B2 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warps" generally refers to machine-direction yarns and the term "shutes" generally refers to cross-machine direction yarns, although it is known that fabrics can be manufactured in one orientation and run on a paper machine in a different orientation.

As used herein, the term "directly adjacent" when referring to the relation of one filament to another means that no other filaments are disposed between the referenced filaments. For example, if two warp filaments forming a portion of a protuberance are said to be directly adjacent to one another no other warp filaments are disposed between the two protuberance forming warp filaments.

As used herein, the term "protuberance" generally refers to a three-dimensional element formed by one or more warp filaments overlaying a plurality of weft yarns. Protuberances may be referred to herein alternatively as three-dimensional elements or simply as elements.

As used herein the term "substantially machine direction oriented" as it refers to a protuberance means that the total length of the line element that is positioned at an angle of greater than 45 degrees to the cross-machine direction is greater than the total length of the line element that is positioned at an angle of 45 degrees or less to the cross-machine direction.

As used herein the term "substantially cross-machine direction oriented" as it refers to a protuberance means that the total length of the line element that is positioned at an angle of greater than 45 degrees to the machine direction is greater than the total length of the line element that is positioned at an angle of 45 degrees or less to the machine direction.

As used herein, the term "protuberance forming portion" refers to the woven warp or shute filaments that form a portion of the protuberance. In certain instances the protuberance forming portion may comprise a plurality of adjacent warp/shute filament interchanges that are woven such that the warp filaments are woven above their respective shute filaments. In certain embodiments a protuberance forming portion may extend substantially in the machine direction and extend over at least five shute filaments in the machine direction, or at least seven shute filaments, or at least ten shute filaments.

As used herein, the term "pocket" generally refers to a portion of the web contacting surface of the papermaking fabric lying between adjacent protuberances.

As used herein, the term "pocket bottom" is defined by the top of the lowest visible yarn which a tissue web can contact when molding into the textured, fabric. The pocket bottom can be defined by a warp knuckle, a shute knuckle, or by both. The "pocket bottom plane" is the z-direction plane intersecting the top of the elements comprising the pocket bottom.

As used here, the term "pocket width" generally refers to the distance between adjacent machine direction (MD) oriented protuberances defining a given pocket and is the Psm value, having units of millimeters (mm), as measured by profilometry and described in the Test Method section below. The pocket width of a given fabric may vary depending on the weave pattern, however, in certain instances the pocket width may range from about 2.0 to about 6.0 mm.

As used herein, the term "pocket depth" generally refers to z-directional depth of a given pocket and is the difference between C2 (95 percentile height) and C1 (5 percentile height) values, having units of millimeters (mm), as measured by profilometry and described in the Test Method section below. In certain instances pocket depth may be referred to as S90. To determine pocket depth a profilometry scan of a fabric is generated as described herein, from which a histogram of the measured heights is generated, and an S90 value (95 percentile height (C2) minus the 5 percentile height (C1), expressed in units of mm) is calculated. Generally the instant fabrics have relatively deep pockets, such as pockets having pocket depths greater than about 1.0 mm, such as from about 1.0 to about 2.0 mm.

As used herein, the term "pocket angle" generally refers to the angle formed between a given pocket bottom and an adjacent machine direction (MD) oriented protuberance and is the Pdq value, having units of degrees (°), as measured by profilometry and described in the Test Method section below. Generally the instant fabrics have relatively steep pocket angles, such as pocket angles greater than about 28 degrees and more preferably greater than about 30 degrees and still more preferably greater than about 32 degrees, such as form about 28 to about 45 degrees and more preferably from about 28 to about 40 degrees and still more preferably from about 30 to about 40 degrees.

As used herein the term "discrete" when referring to an element of a papermaking fabric according to the present invention, such as a pocket, means that the element is visually unconnected from other elements and does not extend continuously in any dimension of the papermaking fabric surface.

As used herein, the term "discrete protuberance" refers to separate, unconnected three-dimensional elements disposed on a papermaking fabric that do not extend continuously in any dimension of the fabric. A protuberance may be discrete despite being formed from a single continuous filament. For example, a single continuous warp filament may be woven such that it forms a plurality of discrete substantially machine direction oriented protuberances where each protuberance has a first proximal end and a first distal end where the ends of the protuberance terminate at spaced apart shute filaments.

As used herein the term "continuous" when referring to a three-dimensional element of a papermaking fabric according to the present invention, such as a protuberance or a pattern, means that the element extends throughout one dimension of the papermaking fabric surface. When referring to a protuberance the term refers to a protuberance comprising two or more warp filaments that extends without interruption throughout one dimension of the woven fabric.

As used herein the term "pattern" when referring to a papermaking fabric of the present invention generally refers to any non-random repeating design, figure, or motif disposed on the fabric surface. Generally the fabrics of the present invention may comprise decorative patterns comprising a plurality of line elements, however, it is not necessary that the line elements form recognizable shapes, and a repeating design of the line elements is considered to constitute a decorative pattern.

DETAILED DESCRIPTION

The present inventors have now surprisingly discovered that certain woven papermaking fabrics, and in particular woven transfer and through-air drying (TAD) fabrics, having patterns disposed thereon may be used to produce tissue webs and products having high bulk and visually appealing aesthetics without compromising operating efficiency. Papermaking fabrics of the current invention are generally directed to woven fabrics but may be suitable as base fabrics upon which to add additional material to enhance tissue physical properties or aesthetics. For example, the instant woven fabrics may be used in the manufacture of a papermaking fabric having a foraminous woven base member surrounded by a hardened photosensitive resin framework. In other instances the instant woven fabrics may be used in the manufacture of a papermaking fabric having a foraminous woven base member with a polymeric material disposed thereon by printing, extruding or well-known additive manufacturing processes.

The present fabrics may be used in the manufacture of a broad range of fibrous structures, particularly wet-laid fibrous structures and more particularly, wet-laid tissue products such as bath tissues, facial tissues, paper towels, industrial wipers, foodservice wipers, napkins, and other similar products. Further, the inventive fabrics are well suited for use in a wide variety of tissue manufacturing processes. For example, the fabrics may be used as TAD fabrics in either uncreped or creped applications to generate aesthetically acceptable patterns and good, bulky tissue product attributes. Alternatively, the fabrics may be used as impression fabrics in wet-pressed papermaking processes.

Accordingly, in one embodiment, the present invention provides a woven papermaking fabric having a textured sheet contacting surface with machine and cross-machine direction topography. The machine direction (MD) topography may be imparted by protuberances oriented substantially in the MD, the protuberances comprising a warp strand supported by a shute strand. In certain instances the substantially oriented MD oriented protuberances may be formed from one, two, three, four or five warp strands supported by one or more shute strands. In a particularly preferred embodiment the MD oriented protuberances comprise two or more, such as two to four warp strands supported by one or more shute strands and substantially all of the MD oriented protuberances within a given fabric are substantially similar.

The width of a given MD oriented protuberance may vary depending on the number of warp strands forming the protuberance and the diameter of the strands. In certain instances, it may be desirable to form the MD oriented protuberances from warp strands having a diameter greater than about 0.1 mm, such as from about 0.1 to about 1.5 mm, such as from about 0.4 to about 1.0 mm, and for the resulting MD oriented protuberances to have a width greater than about 0.1 mm and more preferably greater than about 0.3 mm, such as from about 0.1 to about 5.0 mm, such as from about 0.3 to about 3.0 mm. Of course, it is contemplated that the width of the protuberance can be outside of the preferred range in some embodiments and still be within the scope of the present invention.

The MD oriented protuberances may be woven such that they are interrupted periodically by substantially CD oriented protuberances formed from at least one shute filament. In this manner the MD oriented protuberances may be discontinuous and their length, generally measured between the point at which the MD protuberance is interrupted by a CD protuberance, may be about 2.0 mm or greater, such as greater than about 5.0 mm, such as from about 2.0 to about 50.0 mm, such as from about 5.0 to about 20.0 mm and more preferably from about 5.0 to about 10.0 mm.

In a particularly preferred embodiment a first MD oriented protuberance comprises a first warp filament extending in a first longitudinal direction and disposed adjacent to the first proximal end of the at least one shute element forming a CD oriented protuberance and a second MD oriented protuberance comprising a second warp filament extending in a second longitudinal direction, which direction is generally opposite that of the first warp filament, and disposed adjacent to the first distal end of the at least one shute element.

The MD oriented protuberances are generally spaced apart from one another in the cross-machine direction (CD) of the fabric. In a particularly preferred embodiment the fabric is woven such that substantially all of the MD oriented protuberances are spaced apart from one another a similar distance. The fabrics may be woven such that the MD oriented protuberances may be separated from one another by about 0.5 to about 10.0 mm, such as from about 1.0 to about 5.0 mm. In a particularly preferred embodiment the woven fabric comprises a plurality of MD oriented protuberances formed from a one or more warp strands supported by one or more shute strands, wherein the MD oriented protuberances are substantially equally spaced apart from one another in the CD a distance from about 1.0 to about 5.0 mm.

In addition to having topography created by substantially MD oriented protuberances, the present fabrics also have topography created by protuberances which are generally aligned substantially the cross-machine direction (CD). The substantially CD oriented protuberances are generally formed from at least one shute filament supported by at least one warp filament. The CD oriented protuberance may be formed from one or more shute filaments woven above the supporting warp filaments and provide the protuberance with a first proximal end and a first distal end. In a particularly preferred embodiment the proximal and distal ends of the shute filament contact and support a first warp filament forming a first substantially MD oriented protuberance and a second warp filament forming a second substantially MD oriented protuberance.

Because the CD oriented protuberances are generally formed from at least one shute filament supported by at least one warp filament the CD oriented protuberances generally lie above a first upper surface plane of the papermaking fabric. In certain instances the upper surface of the CD oriented protuberances may lie in a second fabric elevation that is substantially planar with the MD oriented protuberances. In other instances the upper surface of the CD oriented protuberances may lie in a second fabric elevation below the surface plane defined by the upper surface of the MD oriented protuberances. Regardless of whether the MD and CD protuberances are co-planar or out of plane with one another, the z-directional distance between the top plane of the CD oriented protuberances and the lowest visible fabric surface the tissue web may contact during manufacture, may be from about 0.2 to about 5.0 mm, more specifically about 0.5 to about 2.5 mm, more specifically from about 0.75 to about 1.5 mm, and still more specifically from about 1.5 to about 2.5 mm. In certain instances the lowest visible fabric surface the tissue web may contact during manufacture is the over-1-shute warp knuckle within the fabric pocket.

In certain embodiments the substantially MD and CD oriented protuberances may be arranged so as to define discrete pockets having any number of different shapes. In one instance the MD and CD oriented protuberances may form four-sided pockets where a first pair of opposing sides are defined by a first and a second MD oriented protuberance and a second pair of opposing sides are defined by a first and a second CD oriented protuberance. In this manner the fabric may have discrete pockets bounded on four sides by the MD and CD oriented protuberances and a rectilinear shape.

In other embodiments the instant fabrics may be woven such that the MD and CD oriented protuberances define discrete parallelogram shaped pockets. In still other embodiments the instant fabrics may be woven such that the MD and CD oriented protuberances define discrete protuberances having more than four sides, such as a six sided pocket having a hexagonal shape.

While in certain embodiments the weave pattern may yield pockets having a rectilinear shape, such as a four sided rectilinear pocket having a square or rectangular shape, in certain instances not all of the corners may form a right-angle. Further, as one skilled in the art will appreciate, because the sides of the pockets are formed from woven shutes and warps, the sides may not be straight and sides may not intersect one-another at right angles. Accordingly, the sides the pockets can be relatively even or uneven, depending upon the contour of the shute or warp filament from which they were formed. Regardless of the degree of "unevenness" of the sides of the pockets, it is generally preferred that the pockets are discrete such that adjacent pockets are not connected to one another. Further, the upper surface of the pocket may be vertical or sloped. In many cases, the uppermost CD oriented protuberances can be at a lower level than the uppermost MD oriented protuberances and vice versa. The dimensions of the pockets can be determined by various means known to those skilled in the art, including simple photographs of plan views and cross-sections. Surface profilometry is particularly suitable, however, because of its precision. One such surface profilometry method of characterizing the pocket structure, is hereinafter described.

In other embodiments the weave pattern may yield a pocket having a pair of parallel sides, such as opposed generally parallel MD oriented sides and curvilinear top or bottom sides. For example, the weave pattern may result in a pair of parallel MD oriented protuberances that form the side walls of the pocket and a third MD oriented protuberance disposed between the pair and extending in generally an opposite direction so as to strain the shute filament(s) forming the CD oriented protuberance causing it to become distorted. Distortion of the CD oriented protuberances in this manner result in a pocket having generally straight and parallel side walls, but top and bottom walls that are curvilinear.

In particularly preferred embodiments the inventive fabrics are woven such that the discrete pockets are formed from MD and CD oriented protuberances having upper surface planes that lie above the lowest visible fabric surface the tissue web may contact during manufacture, such as the over-1-shute warp knuckle within the fabric pockets. In such embodiments the discrete pockets are provided with a z-directional depth, generally referred to herein as a pocket depth, which may range from about 0.5 to about 5.0 mm, such as from about 0.75 to about 3.0 mm, such as from about 1.0 to about 3.0 mm. Provided variability in the weaving process the depth of pockets within a given fabric may vary to some degree. In certain embodiments, however, it may be preferable to provide a fabric having a plurality of pockets where the pocket depth is substantially equal amongst the plurality of pockets, such as a difference of less than about 10 percent and more preferably less than about 5 percent.

The warp and shute filaments may be woven in a variety of patterns to provide discrete pockets having a range of dimensions. For example, in certain embodiments the discrete pockets may have a rectilinear shape where CD and MD protuberances have a length and width that is substantially equal and ranges from about 1.0 to about 20.0 mm, such as from about 5.0 to about 15.0 mm. In other embodiments the CD and MD protuberances may be woven so as to provide pocket areas, generally measured along the upper surface plane of the pocket, from about 50 to about 500 $mm^2$, more specifically from about 100 to about 300 $mm^2$. The frequency of occurrence of pockets on the tissue-contacting surface of the fabric may be from about 0.5 to about 10 pockets per square centimeter, such as from about 1.0 to about 5.0 pockets per square centimeter.

Figure 2:
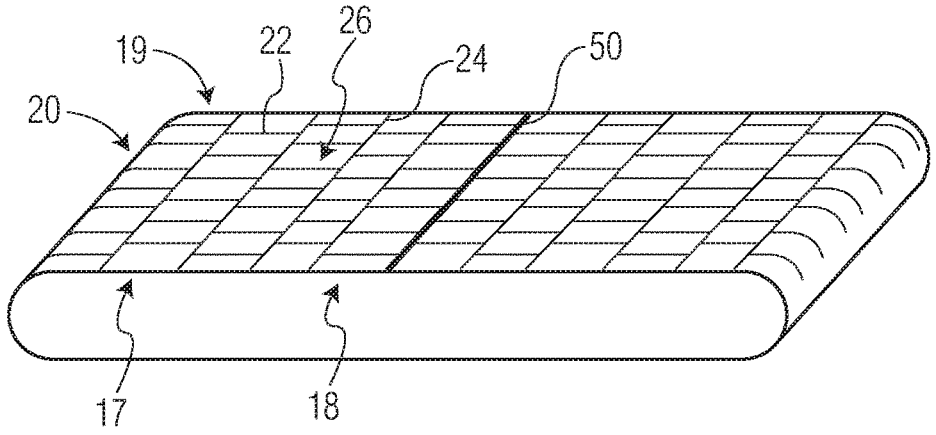
FIG. 2 illustrates the woven papermaking fabric of FIG. 1 in seamed configuration.

With reference now to FIGS. 1 and 2, one embodiment of a papermaking fabric according to the present invention is illustrated. The papermaking fabric can include a first longitudinal end 13 and a second longitudinal end 15 that can be joined to form a seam 50 as shown in FIG. 2. The fabric further comprises opposed lateral edges 17, 19. The papermaking fabric 10 generally comprises a plurality of filaments that can be woven together. As will be described in further detail below, the filaments can include a plurality of warp filaments and a plurality of shute filaments that can be woven together to form a machine contacting side 18 and a web contacting side 20 of the woven papermaking fabric 10. The web contacting side 20 can be opposite from the machine contacting side 18. Machinery employed in a typical papermaking operation is well known in the art and may include, for example, vacuum pickup shoes, rollers, and drying cylinders. In a preferred embodiment, the papermaking fabric 10 comprises a through-air drying fabric useful for transporting an embryonic tissue web across drying cylinders during the tissue manufacturing process. However, in other embodiments, the woven papermaking fabric 10 can comprise a transfer fabric for transporting an embryonic tissue web from forming wires to a through-air drying fabric. In these embodiments, the web contacting side 20 supports the embryonic tissue web, while the opposite surface, the machine contacting side 18, contacts the surrounding machinery.

The web contacting side 20 of the papermaking fabric 10 can include a plurality of substantially MD oriented protuberances 22 and a plurality of substantially CD oriented protuberances 24, which are arranged so as to intersect one another and define discrete rectilinear shaped pockets 24. The MD and CD oriented protuberances are generally disposed on the web contacting surface 20 of the fabric 10 and cooperate with and structures the wet fibrous web during manufacturing. In preferred embodiments, such as the embodiment illustrated in FIG. 1, the web contacting side 20 of the papermaking fabric 10 can include a plurality of discrete substantially MD oriented protuberances 22*a*-22*d* that are intersected by spaced apart continuous CD oriented protuberances 24*a*, 24*b* to form a pocket 26*a*.

In certain embodiments substantially MD and CD oriented protuberances 22, 24 may form about 5 percent of the surface area of the web contacting side 20, such as from about 5 to about 35 percent, more preferably from about 10 to about 30 percent, even more preferably from about 10 to about 25 percent, and still more preferably from about 20 to about 25 percent of the surface area of the web contacting side 20. In some embodiments, particularly embodiments where the papermaking fabric 10 can serve as a transfer fabric, MD and CD oriented protuberances 22, 24 may form about 5 percent of the surface area of the web contacting side 20, such as from about 5 to about 80 percent, more preferably from about 10 to about 70 percent, even more preferably from about 30 to about 50 percent, and still more preferably from about 40 to about 50 percent of the surface area of the web contacting side 20. Of course, it can be appreciated that in some embodiments the MD and CD oriented protuberances 22, 24 can form a percentage of the surface area of the web contacting side 20 outside of these ranges and still be within the scope of the present invention.

With continued reference to FIG. 1 the pockets 24 are generally surrounded, or bound, by MD and CD oriented protuberances 22, 24. The pockets 26 are generally permeable to liquids and allow water to be removed from a wet-laid sheet of cellulosic fibers by the application of differential fluid pressure, by evaporative mechanisms, or both when drying air passes through the sheet while on the papermaking fabric 10 or a vacuum is applied through the papermaking fabric 10. Without being bound by any particularly theory, it is believed that the arrangement of protuberances 22, 24 and pockets 26 may facilitate the molding of the sheet of cellulosic fibers causing fibers to deflect in the z-direction and generate the caliper of, and aesthetic patterns on, the resulting tissue web.

The plurality of MD and CD oriented protuberances 22, 24 can be arranged to provide a pattern 60 of discrete, similarly rectilinear shaped pockets 26. While the MD and CD oriented protuberances 22, 24 illustrated in FIG. 1 are of the same design, the invention is not so limited and it is contemplated that a papermaking fabric 10 can include a plurality of protuberances 22, 24 forming pockets 26 having two or more different shapes. The MD and CD oriented protuberances 22, 24 can form an array of rows and/or columns, and in some embodiments, can be evenly spaced in either or both the machine direction (MD) and the cross-machine direction (CD).

Figure 3:
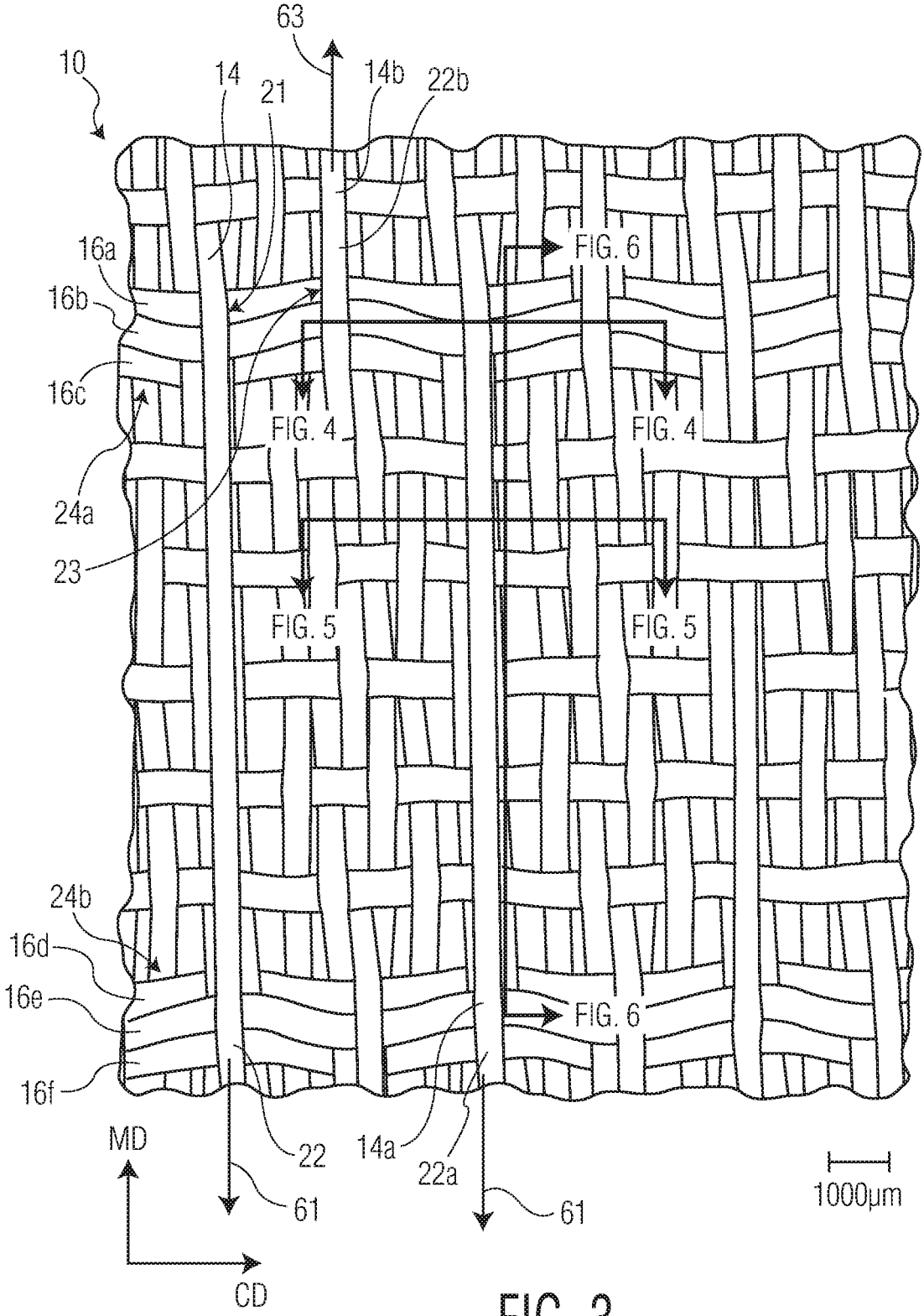
FIG. 3 is a top view of a woven papermaking fabric having a three-dimensional fabric contacting surface according to one embodiment of the present invention.

With reference now to FIG. 3, one embodiment of a papermaking fabric 10 having substantially MD and CD oriented protuberances 22, 24 is illustrated. The substantially MD oriented protuberances 22 are generally formed from woven warp filaments 14 woven above their corresponding shute filaments 16 and having a first proximal end and a first distal end. While the substantially MD oriented protuberances 22 of FIG. 3 comprise a single machine direction oriented warp filament 14*a*, the invention is not so limited and the substantially MD oriented protuberances 22 may comprise one, two, or more directly adjacent warp filaments supported by a plurality of shute filaments 16.

The fabric 10 generally comprises a plurality of MD oriented protuberances 22 spaced apart from one another in the cross-machine direction. In a particularly preferred embodiment the substantially MD oriented protuberances are arranged pairwise to form the sidewalls of a discrete pocket and more preferably are substantially parallel to one another and have similar dimensions such as length and width.

Further, in certain embodiments, a third MD oriented protuberance 22*b* may be disposed between the pairwise arranged first and second MD oriented protuberances 22 and 22*a*. As illustrated in FIG. 3, the first and second MD oriented protuberances 22 and 22*a* generally extend in a first longitudinal direction 61 and the third MD protuberance 22*b* extends in a second longitudinal direction 63, which direction is generally opposite that of the first and second MD oriented protuberances 22, 22*a*.

The fabric 10 also comprises a plurality of CD oriented protuberances 24, which are formed from woven shute filaments 16. The CD oriented protuberances are generally formed from a plurality of directly adjacent shute filaments. Accordingly, in certain embodiments, a CD oriented protuberance 24 may comprise from two or more shute filaments, such as from two to eight shute filaments and more preferably from three to six, shute filaments. Generally the shute filaments forming the CD oriented protuberance are woven such that they are not tied to the underlying fabric structure except by the warp filament forming the MD oriented protuberance.

The substantially CD oriented protuberances 24 may extend continuously across the fabric 10 in the cross-machine direction. The shute filaments 16*a*-16*c* forming the protuberances 24*a* are directly adjacent to one another and woven such that they are not tied to the underlying fabric except where they intersect warp filaments 14 forming the MD oriented protuberances 22. In this manner, the point at which the CD oriented protuberance 24 contacts a MD oriented protuberance 22 may define a first proximal end 21 and the point at which the CD oriented protuberance 24 contacts a second MD oriented protuberances 22*b* may define a first distal end 23. The MD oriented protuberances 22 are generally arranged such that the first proximal end is generally disposed adjacent to a first CD oriented protuberance 24*a* formed from a first plurality of woven shute filaments 16*a*-16*c* and the first distal end is generally disposed adjacent to a second CD oriented protuberance 24*b* formed from a second plurality of woven shute filament 16*d*-16*f*, where the first and second CD oriented protuberances 24*a*, 24*b* are spaced apart from one another in the machine direction.

Figure 4:
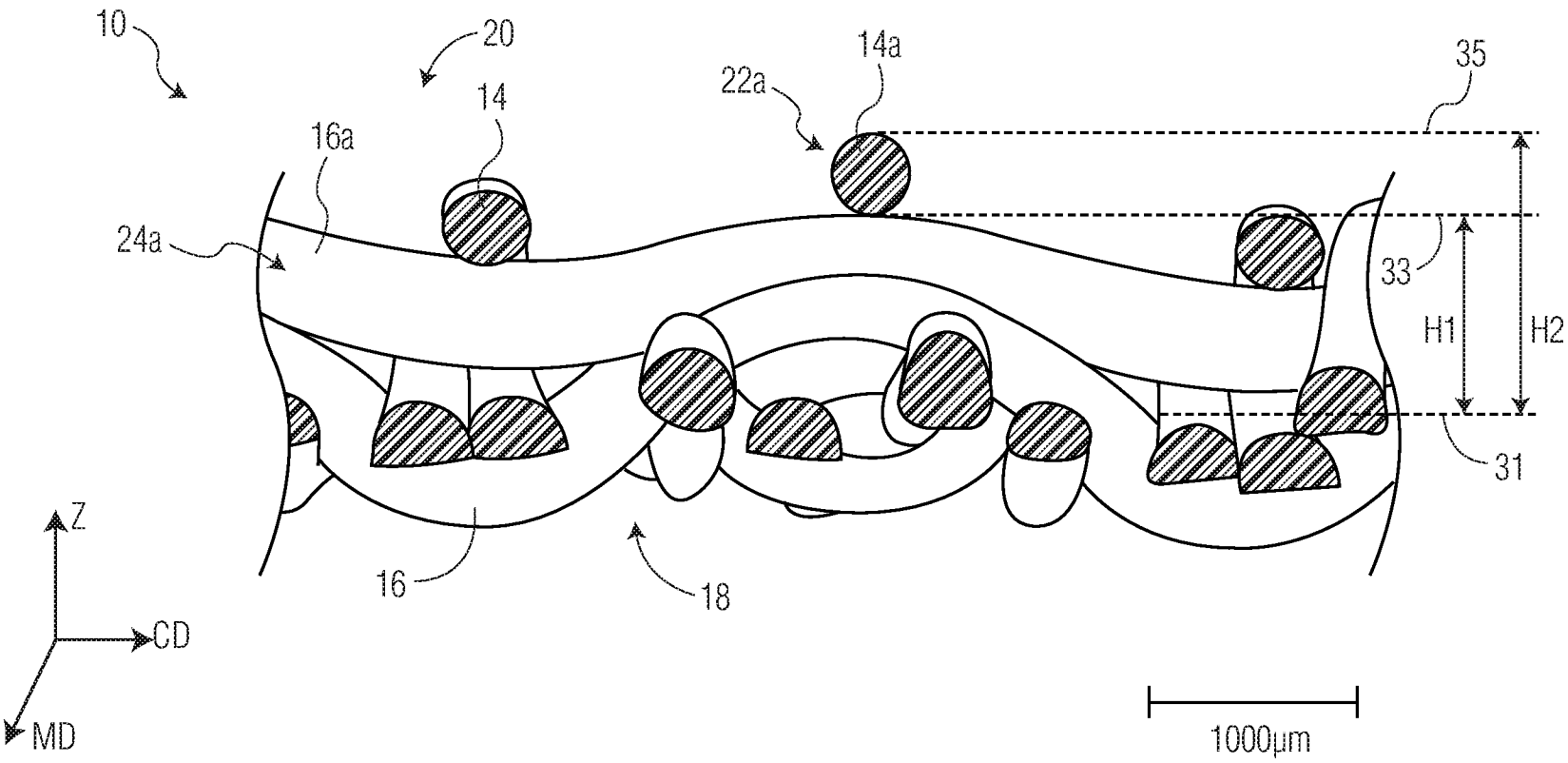
FIG. 4 is a cross-section view of the fabric of FIG. 3 through the line 4-4.
Figure 5:
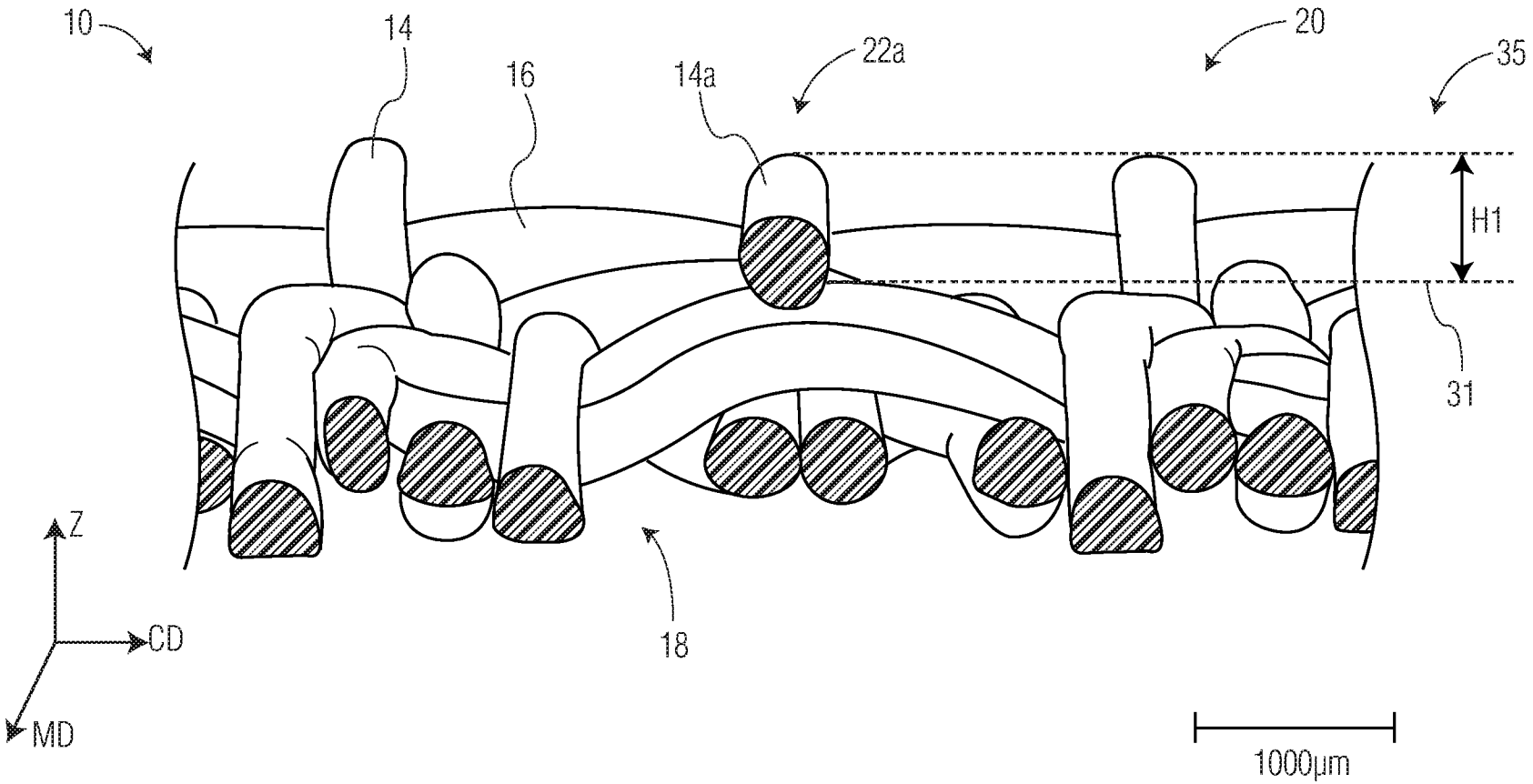
FIG. 5 is a cross-section view of the fabric of FIG. 3 through the line 5-5.
Figure 6:
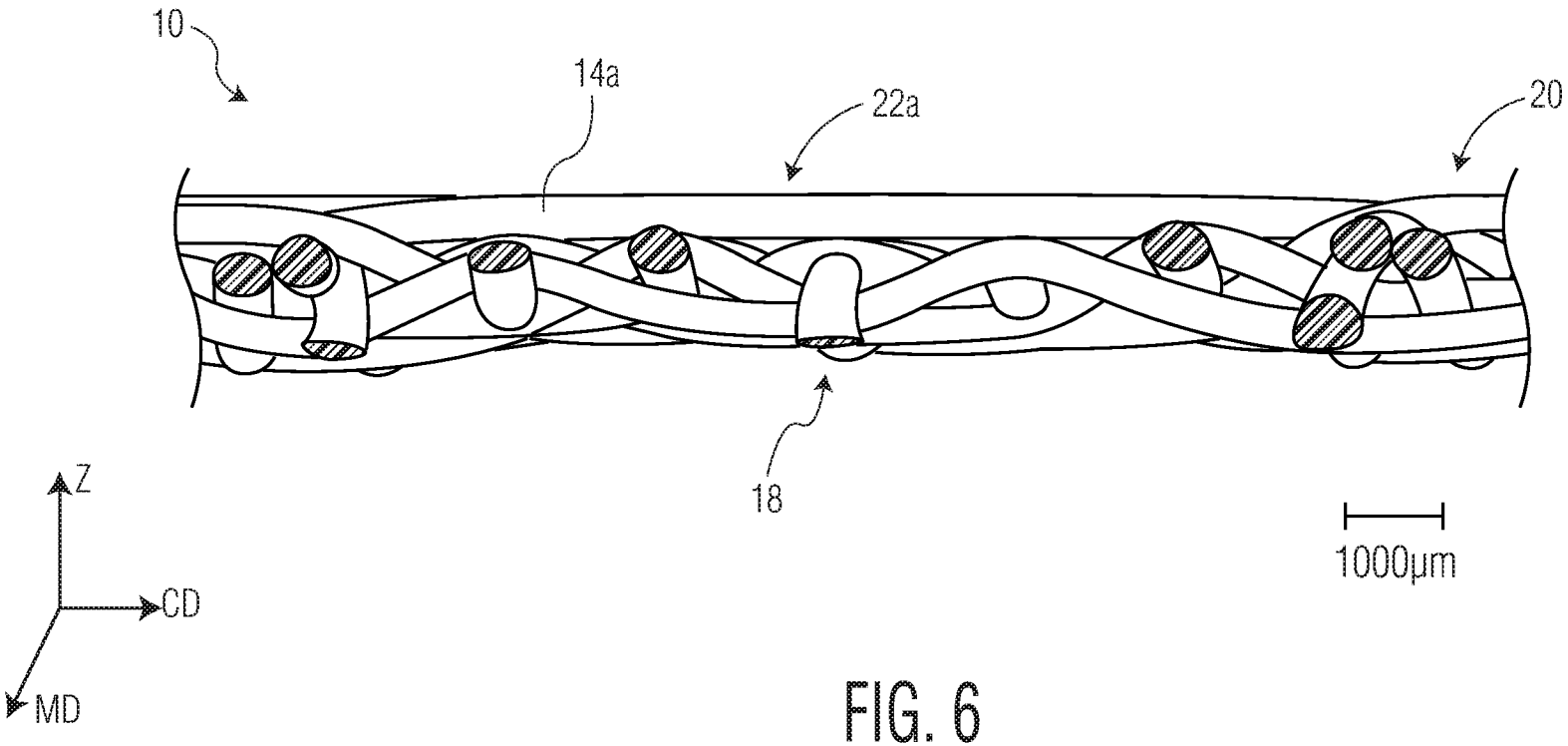
FIG. 6 is a cross-section view of the fabric of FIG. 3 through the line 6-6.

As illustrated in the cross-sectional illustrations of FIGS. 4-6, the MD and CD oriented protuberances 22, 24 can be areas of tightly woven warp 14 and shute 16 filaments. For example, various weave patterns can be configured to provide areas of tightly woven areas and loosely woven areas in which the loosely woven areas push out of plane to create a protuberance. Various weave patterns that can provide a stabilized woven papermaking fabric will be described in further detail below. The MD and CD oriented protuberances 22, 24 can have a height (labeled as H1 and H2 respectively in in FIG. 4). Generally the height of a protuberance is measured from the pocket bottom plane to the relevant protuberance surface plane. For example, as illustrated in FIG. 4, the height (H1) of the CD oriented protuberance 24 is measured from the pocket bottom plane 31 to the upper most surface plane 33 of the CD oriented protuberance 24. Similarly the height (H2) of the MD oriented protuberances 22 may be measured from the pocket bottom plane 31 to the upper most surface plane 35 of the MD oriented protuberance 22.

The height of the protuberances (H1 and H2) can be of varied, such as from about 0.1 to about 5.0 mm, more preferably from about 0.2 to about 3.0 mm, or even more preferably from about 0.5 to about 1.5 mm. Of course, it is contemplated that the height can be outside of this preferred range in some embodiments. In certain embodiments H2 is greater than H1. Regardless of the relative heights of the MD and CD oriented protuberances, both the MD and CD oriented protuberances lie above the bottom surface plane. The respective heights, H1 and H2, may be measured using profilometry as described below.

The MD and CD oriented protuberances generally have a length that is measured in the principal dimension of the protuberance in the plane defined by the machine direction and cross-machine direction at a given location. Thus, the length of the substantially MD oriented protuberances can be measured in the machine direction (MD) or can be measured in the cross-machine direction (CD) for substantially CD oriented protuberances. If the protuberance extends continuously in one dimension of the papermaking fabric, such as the substantially continuously extending CD protuberances 24 of FIG. 1, the length of the protuberance could be considered as the entire width dimension of the papermaking fabric 10. The width of some papermaking fabrics may exceed 10 meters, and as such, the length of a continuous protuberance extending in the CD may be 10 meters or more.

In other embodiments the protuberances may be discrete. For example, with reference to FIG. 1, the substantially MD oriented protuberances 22, may be discrete and have a length greater than about 2.0 mm, and more preferably greater than about 5.0 mm, such as from about 2.0 to about 50.0 mm or from about 5.0 to about 20.0 mm. Of course, it is contemplated that the length can be outside of this preferred range in some embodiments having discrete protuberances. Alternatively, the length of an element, such as a MD oriented protuberance, may be expressed relative to the number of floats that it traverses in the woven structure. For example, a MD oriented protuberance may comprise a protuberance forming warp filament extending substantially in the machine direction over at least five shute filaments would have a float length of five. In certain embodiments, the MD oriented protuberances may have a float length of at least five, such from five to forty and more preferably from five to thirty, such as from seven to fifteen.

The protuberances also have a width. The protuberance width is generally measured normal to the principal dimension of the protuberance in a plane defined by the cross-machine direction (CD) at a given location. Where the protuberance has a generally square or rectangular cross-section, the width is generally measured as the distance between the two sidewalls that form the protuberance. Where the protuberance has substantially planar sidewalls, the width is measured between the planes defining the sidewalls. In those embodiments where the protuberance does not have planar sidewalls the width is measured at the point that provides the greatest width for the configuration of the protuberance. For example, the width of a protuberance not having two planar sidewalls may be measured along the base of the protuberance. In some preferred embodiments, the width of the protuberances may be greater than about 0.1 mm and more preferably greater than about 0.3 mm, such as from about 0.1 mm to about 5.0 mm, such as from about 0.3 to about 3.0 mm. Of course, it is contemplated that the width (W) can be outside of the preferred range in some embodiments and still be within the scope of the present invention.

If a papermaking fabric includes multiple protuberances, it is contemplated that a plurality of or all of the protuberances can be configured substantially the same in terms of any one or more of characteristics of height, width, or length. It is also contemplated that a papermaking fabric can be configured with protuberances configured such that one or more characteristics of height, width, or length of the protuberances vary from one protuberance to another protuberance. In certain embodiments substantially all of the MD oriented protuberances may have similar characteristics of height, width, or length and substantially all of the CD oriented protuberances may have similar characteristics of height, width, or length, where the characteristics of the MD and CD oriented protuberances is different.

The spacing and arrangement of protuberances may vary depending on the desired properties and appearance of tissue products manufactured therewith. In some embodiments, the protuberances can be spaced apart across the entire cross-machine direction length of the papermaking fabric, such as the spaced apart MD oriented protuberances 22 illustrated in FIG. 1, which are spaced apart from one another and extend entirely in the MD of the fabric 10. Additionally or alternatively, the protuberances can be configured to extend continuously in one dimension of the papermaking fabric, such as the continuous CD protuberances 24 illustrated in FIG. 1. Further, a given protuberance may be spaced apart from other protuberance, such as the MD oriented protuberances 22 of FIG. 1, which are spaced apart from one another across the cross-machine direction of the fabric 10. Of course, the direction of the protuberance alignments (machine direction, cross-machine direction, or diagonal) discussed above refer to the principal alignment of the protuberance. Within each alignment, the protuberances may have segments aligned at other directions, but aggregate to yield the particular alignment of the entire protuberances.

Generally the protuberances are spaced apart from one another so as to define a pocket there-between. In certain instances, such as when the inventive papermaking fabrics are used as a through-air drying fabric, the fibers of the embryonic tissue web are deflected in the z-direction by the protuberances forming the pocket and disposed along the pocket bottom plane to yield a web having a three-dimensional topography. The spacing of protuberances can be provided such that the tissue web conforms to the protuberances and is deposited in the pocket without tearing. The size, spacing and arrangement of the pockets may be optimized to provide the resulting tissue web with desired aesthetics or physical properties.

In those embodiments where either the CD or MD oriented protuberances are generally aligned in one direction, the center-to-center spacing between adjacent protuberances can be defined as the pitch (P) of the protuberances. In some embodiments, such as the embodiment depicted in FIG. 1, the MD oriented protuberances 22 can be configured such that they are generally aligned in the machine direction (MD) and substantially equally spaced apart from one another such that the pitch (P1) is relatively uniform. In certain instances, such as that illustrated in FIG. 1, the pitch (P1) defines the width of the pocket 26 in the cross-machine direction such that P1 and pocket width are equal.

Regardless of the direction of the alignment of the protuberances, the pitch (P1) can be greater than about 1.0 mm, such as from about 1.0 to about 10.0 mm apart and more preferably from about 1.0 to about 5.0 mm apart and still more preferably from about 2.0 to about 4.0 mm apart. In one particularly preferred embodiment where the papermaking fabric is used as a transfer fabric, the MD oriented protuberances can be spaced apart from one another a pitch (P1) from about 1.0 to about 5.0 mm. In this manner the fabric may have a plurality of pockets having a width from about 1.0 to about 10.0 mm, such as from about 1.0 to about 8.0 mm and more preferably from about 4.0 to about 6.0 mm. Similarly the CD oriented protuberances 24 can be spaced apart from one another a pitch (P2) from about 1.0 to about 20.0 mm, such as from about 5.0 to about 15.0 mm. This arrangement can provide a tissue web having three-dimensional surface topography, yet relatively uniform density.

In other contemplated embodiments, the pitch (P1) of the MD oriented protuberances and/or the pitch (P2) of the CD oriented protuberances can vary throughout the machine direction (MD) and/or cross-machine direction (CD), respectively. Regardless of the spacing and arrangement of protuberances of a particular orientation, the protuberances are separated from one another by some minimal distance and intersect one another to form discrete pockets. In a particularly preferred embodiment the CD oriented protuberances are substantially continuous in the cross-machine direction and equally spaced from one another, and the MD oriented protuberances are discrete and equally spaced from one another, where P1 is from about 2.0 to about 5.0 mm and P2 is from about 5.0 to about 15.0 mm.

Several exemplary woven papermaking fabrics are illustrated in the attached figures. The illustrated fabrics are woven so as to form a plurality of discrete pockets and may be useful in the manufacture of tissue products, particularly the manufacture of through-air dried tissue products. The illustrated fabrics generally have pocket depths greater than about 1.0 mm, such as from about 1.0 to about 2.0 mm and pocket widths from about 4.0 to about 6.0 mm. The fabrics are woven such that the discrete pockets have relatively steep sidewalls, such as pocket angles greater than about 28 degrees and more preferably greater than about 30 degrees, such as from about 28 to about 45 degrees. The dimensions of the discrete pockets found in the illustrated papermaking fabrics are summarized in the table below.

TABLE 1

Figure 9A:
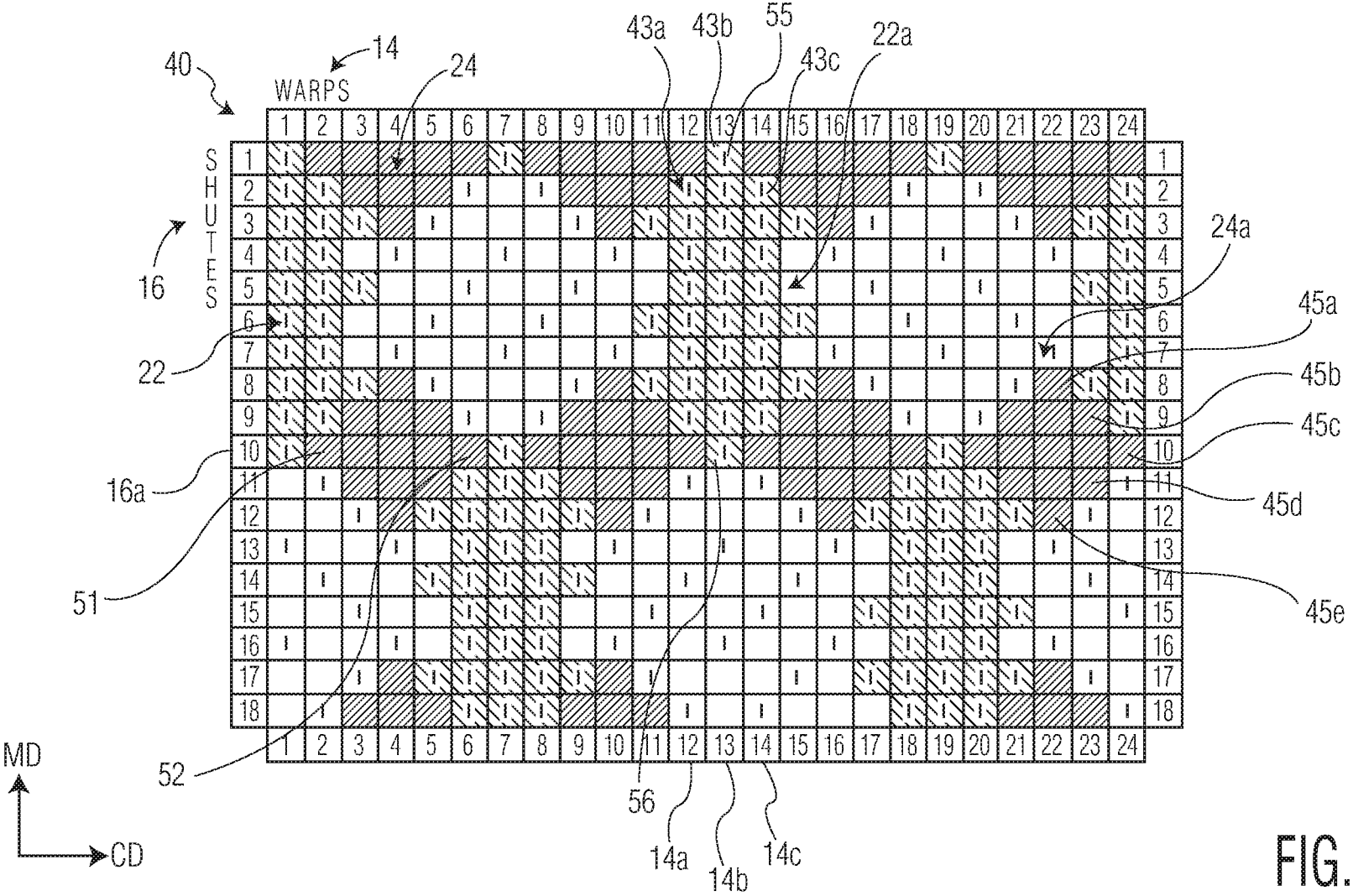
FIG. 9A illustrates another exemplary weave pattern useful in the manufacture of a woven papermaking fabric according to the present invention.
Figure 10A:
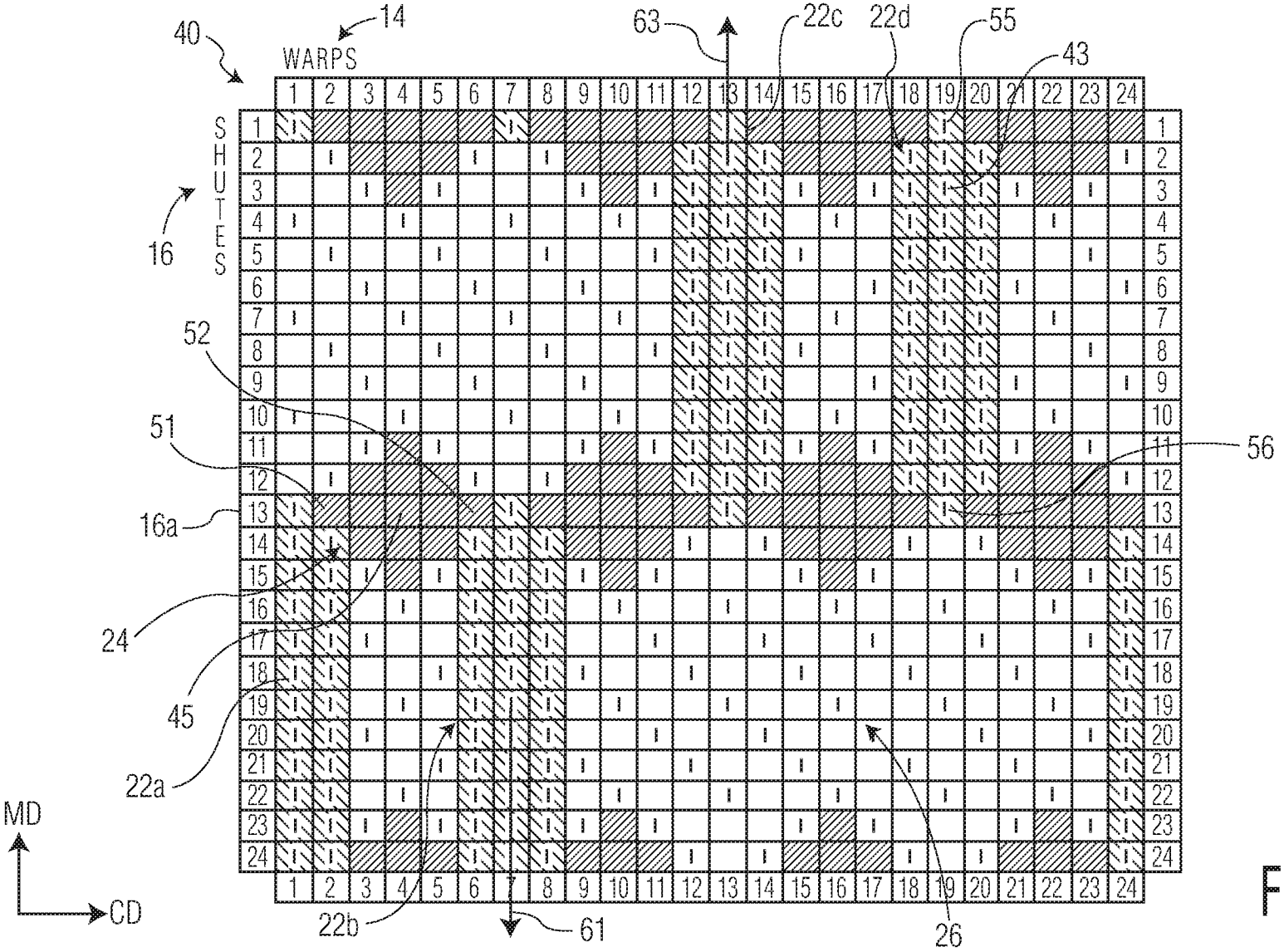
FIG. 10A illustrates another exemplary weave pattern useful in the manufacture of a woven papermaking fabric according to the present invention.
Figure 11A:
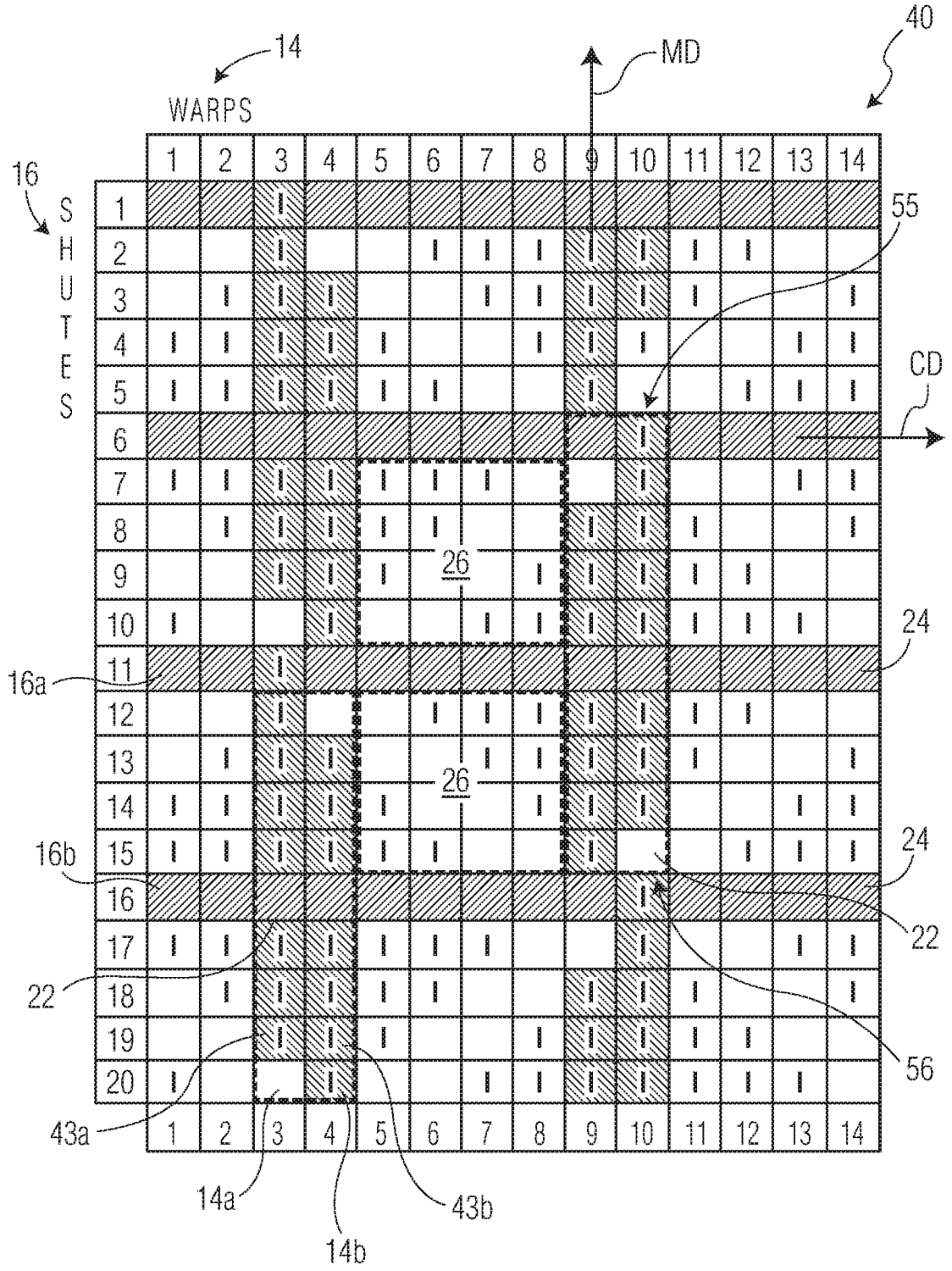
FIG. 11A is another exemplary weave pattern useful in the manufacture of a woven papermaking fabric according to the present invention.
Figure 12A:
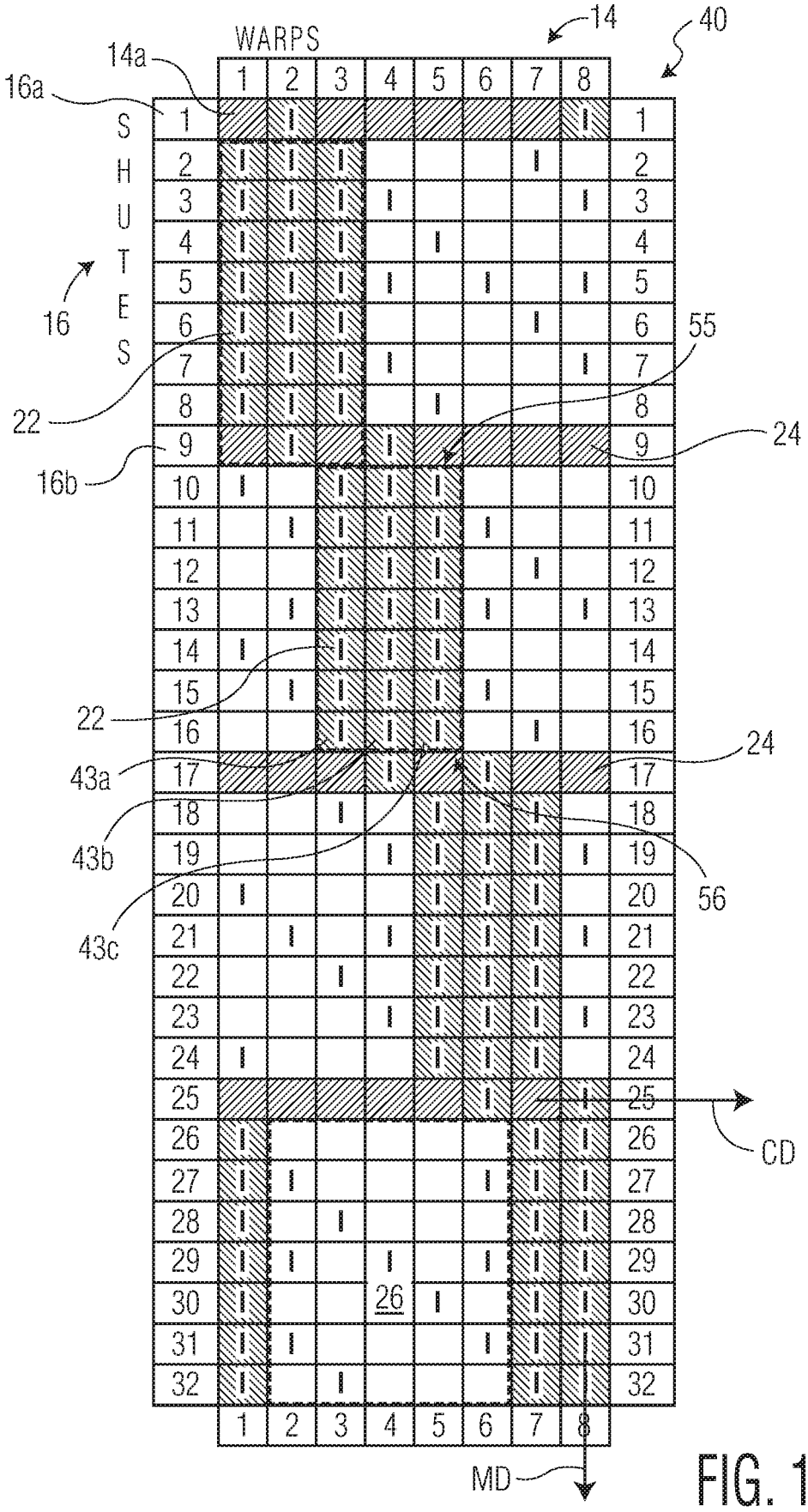
FIG. 12A is another exemplary weave pattern useful in the manufacture of a woven papermaking fabric according to the present invention.
Figure 13A:
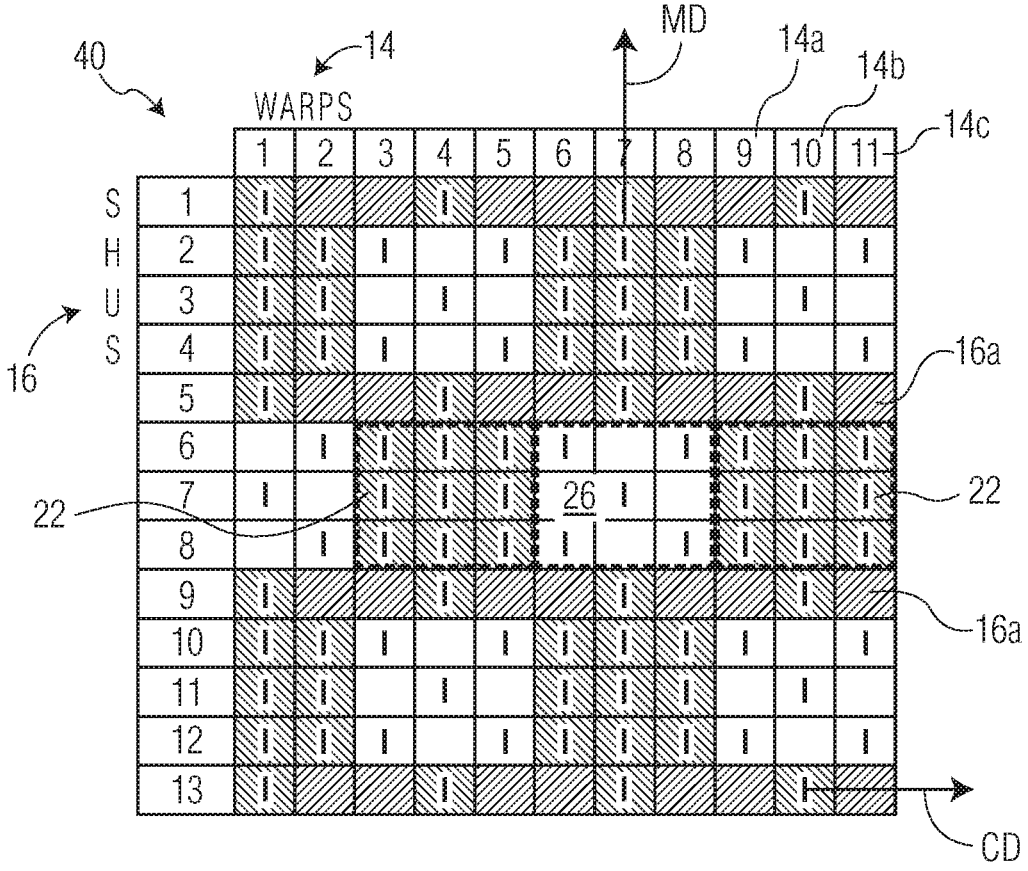
FIG. 13A is another exemplary weave pattern useful in the manufacture of a woven papermaking fabric according to the present invention.

| Illustrated Fabric | Pocket Depth (mm) | Pocket Width (mm) | Pocket Angle (°) |
|---|---|---|---|
| FIG. 9A | 1.17 | 4.67 | 37.5 |
| FIG. 10A | 1.01 | 5.97 | 28.1 |
| FIG. 11A | 1.66 | 5.16 | 41.3 |
| FIG. 12A | 1.06 | 4.21 | 29.5 |
| FIG. 13A | 1.08 | 4.40 | 29.1 |

Exemplary weave patterns and methods of manufacturing a woven papermaking fabric will now be described. In one embodiment, the papermaking fabric could be manufactured by providing a first set of filaments and a second set of filaments that are woven in a weave pattern. The first set of filaments can serve as warp filaments in a loom and the second set of filaments can serve as shute filaments in a loom. The method can additionally include weaving the shute filaments with the warp filaments in a lateral direction to provide a web contacting side of the woven papermaking fabric and a machine contacting side of the woven papermaking fabric and to provide a plurality of substantially MD oriented protuberances and a plurality of substantially CD oriented protuberances on the web contacting side of the woven papermaking fabric. Weaving the shute filaments with the warp filaments can be accomplished by following weave patterns.

Figure 7:
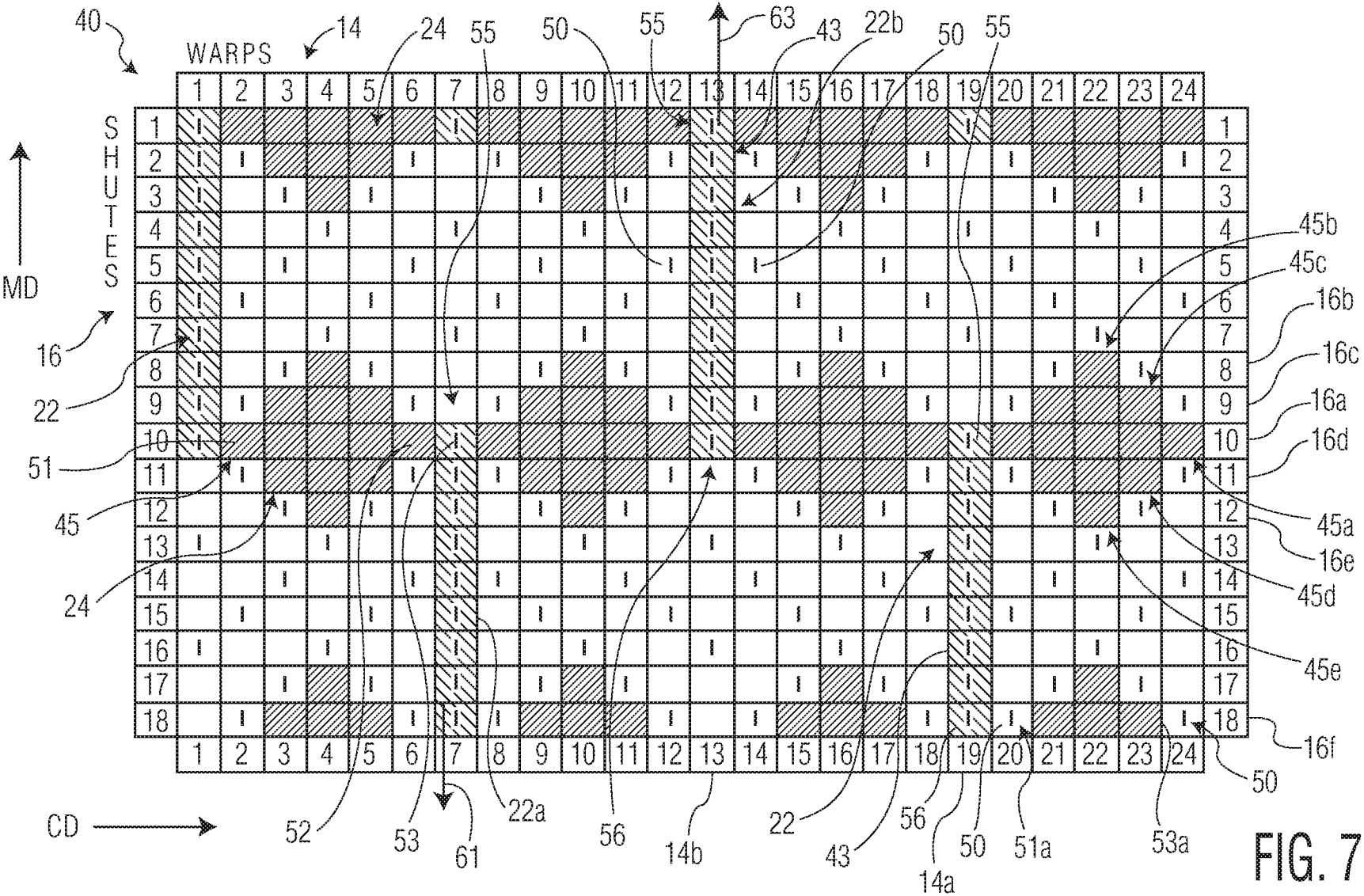
FIG. 7 illustrates a unit cell of an exemplary weave pattern useful in the manufacture of a woven papermaking fabric according to one embodiment of the present invention.
Figure 8:
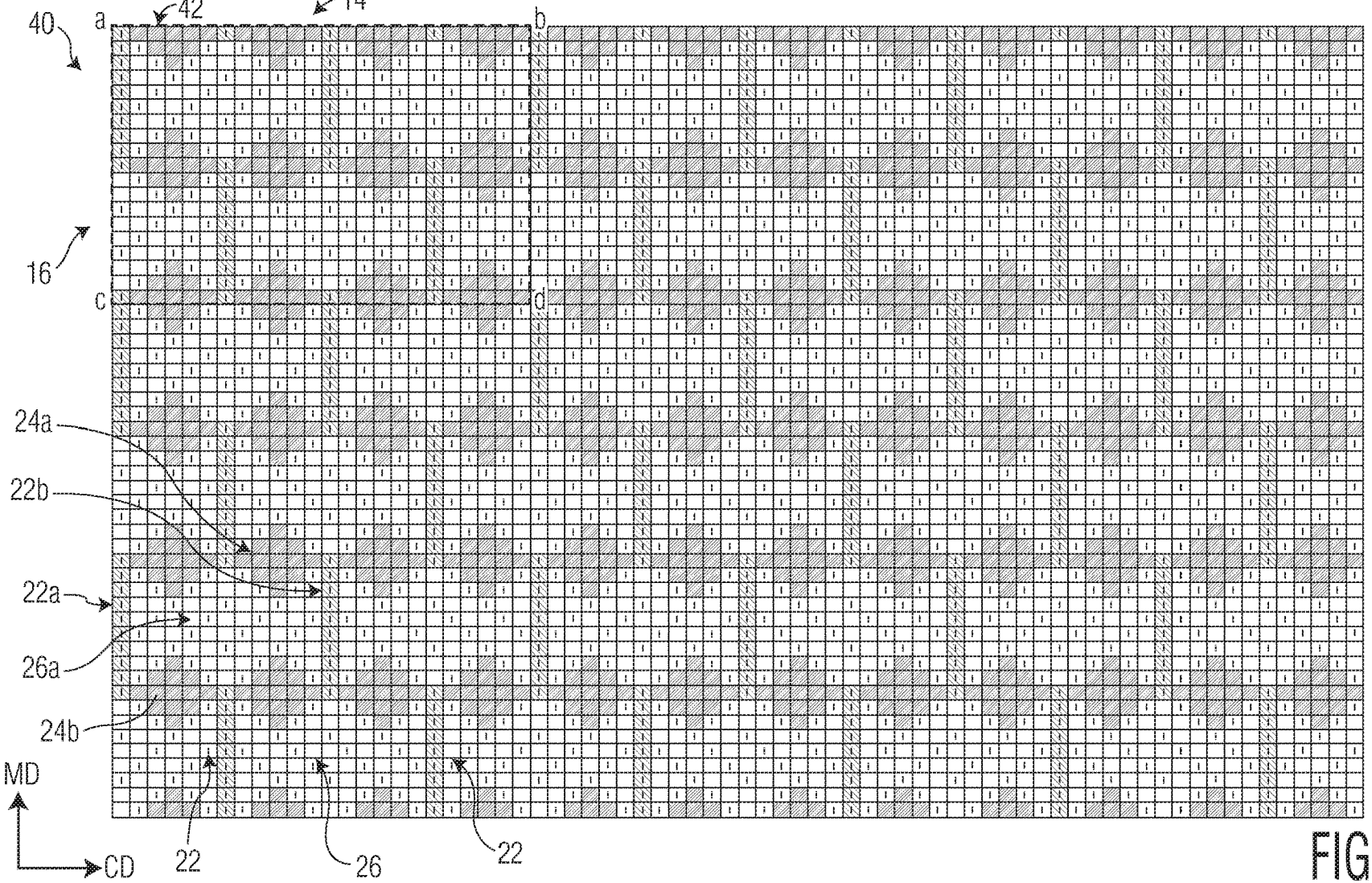
FIG. 8 illustrates an exemplary weave pattern useful in the manufacture of a woven papermaking fabric according to one embodiment of the present invention.

Various weave patterns can be used to guide the weaving of the shute filaments with the warp filaments and provide substantially CD and MD oriented protuberances disposed on the web contacting surface of the papermaking fabric. One exemplary weave pattern 40 is shown in FIG. 7, which illustrates a single unit cell, which may be combined with other unit cells to form a papermaking fabric according to the present invention. Unit cells can be repeated as many times as desired in the machine direction and/or the cross-machine direction to form a desired pattern in a papermaking fabric. As an example, the unit cell (indicated by the box labeled abcd in FIG. 8) may be repeated and combined to create the weave pattern 40 illustrated in FIG. 8. The pattern of FIG. 8 is just one way the unit cell of FIG. 7 may be combined and arranged to create a weave pattern for a papermaking fabric and the skilled artisan will be able to envision alternate means of arranging the unit cell to create a papermaking fabric having a pattern.

The weave pattern 40 of FIG. 7 will now be described in detail, however, the principles of weave pattern 40 may be adapted to form a broad range of unit cells that may be combined to form a variety of patterns according to the present invention. The pattern 40 can include a plurality of warp filaments 14 generally aligned in the machine direction (MD) and a plurality of shute filaments 16 generally aligned in the cross-machine direction (CD). The weave pattern 40 can be configured on a loom (not pictured) such that the web contacting side 20 of the papermaking fabric 10 (as labeled in FIG. 2) will be facing out from the page, and the machine contacting side 18 of the papermaking fabric 10 (as labeled in FIG. 2) will be facing into the page. Of course, it is contemplated that a weave pattern 40 could be configured in the opposite orientation on a loom. Each interchange of a specific warp filament 14 and a specific shute filament 16 of the weave pattern 40 that includes a vertical line segment (or a capital letter "I") provides a notation that the specific warp filament 14 is woven above the specific shute filament 16 at that interchange. For example, the interchange of warp filament No. 1 and shute filament No. 1 includes such a vertical line segment in FIG. 7, and thus, warp filament No. 1 is woven above shute filament No. 1. In some circumstances interchanges of warp filaments and shute filaments that have the vertical line segment (or capital letter "I") that will lead to the development of a protuberance are also shaded with a cross-hatching pattern for purposes of clarity of perceiving the protuberances of the weave pattern provided herein. In other instances where a specific warp filament 14 lies between a specific shute filament 16 at a given interchange the pattern is left blank, such as the interchange of warp filament No. 3 and shute filament No. 4 of FIG. 7.

The weave pattern 40 can be configured to provide MD and CD oriented protuberances 22, 24 that can be provided by a protuberance forming portions 43, 45 of the respective warp 14 or shute 16 filaments forming the protuberance 22 or 24. For purposes, herein, a "MD protuberance forming portion" (labeled as 43) is a continuous area in the weave pattern 40 in which a plurality of adjacent warp/shute filament interchanges are woven such that the warp filaments 14 are woven above their respective shute filaments 16. For example, with reference to FIG. 7, the interchange of warp filament No. 19 and shute filament No. 16 is a MD protuberance forming portion 43 of warp filament 14*a*. As will be discussed in more detail below MD protuberance forming portions 43 can be of various lengths and/or widths to provide MD oriented protuberances 22 of various shapes and sizes.

The weave pattern 40 also comprises CD protuberance forming portions 45, which generally refers to a continuous area in the weave pattern 40 having a plurality of adjacent warp/shute filament interchanges where the warp filaments 14 are woven below their respective shute filaments 16 resulting in the shute filaments 16 forming a CD oriented protuberance 24. For example, with reference to FIG. 7, the interchange of warp filament No. 2 and shute filament No. 10 is a CD protuberance forming portion 45 of shute filament 16*a*. As will be discussed in more detail below CD protuberance forming portions 45 can be of various lengths and/or widths to provide CD oriented protuberances 24 of various shapes and sizes.

As shown in FIG. 7, the weave pattern 40 includes a first CD protuberance forming portion 45*a* which forms a portion of the CD oriented protuberance 24. Looking at a specific shute filament 16*a* (shute position No. 10 in the illustrated weave pattern 40) within the weave pattern 40 in a left-to-right fashion, the shute proximal end 51 can be the interchange of a specific shute filament 16*a* and a specific warp filament 14 that begins a series of adjacent interchanges in which the warp filaments 14 are woven below that specific shute filament 16*a*. The float distal end 52 can be the interchange of a specific shute filament 16*a* and a specific warp filament 14 that ends a series of adjacent interchanges in which the warp filaments 14 are woven below that specific shute filament 16*a*. Thus, the weave pattern for a specific shute filament between a float proximal end and a float distal end can be pictured such that each successive warp filament is woven below that specific shute filament. In other words, for a given CD protuberance forming portion a warp filament is woven below each shute filament between the shute float proximal end and the shute float distal end.

The CD protuberance forming portion 45 of the shute filament 16 is tied to the underlying fabric structure by a warp/shute interchange 53 immediately adjacent to the float proximal end 51 and the float distal end 52 at which a specific warp filament 14 is woven above that specific shute filament 16. The same warp/shute interchange 53 that ties the CD protuberance forming portion of the shute filament to the fabric also forms a first proximal or distal end 55 of a MD oriented protuberance 22 as will be discussed in more detail below.

With continued reference to FIG. 7, the CD oriented protuberance 24 further comprises second, third, fourth and fifth CD protuberance forming portions 45*b*-*e* of shute filaments 16*b*-16*e* (shute positions 8, 9, 11 and 12). The resulting CD oriented protuberance 24 has a float width of 5 (measured at its widest point) and a float length of 5 (measured at its longest point) and consists of a series warp/shute adjacent interchanges in which the warp filaments 14 are woven below the shute filaments 16. The CD oriented protuberance 24 includes a CD protuberance forming portion 45*a* that extends substantially continuously across the weave pattern in the cross-machine direction and is only interrupted by MD protuberance forming portions where CD protuberance forming portion is tied to the underlying fabric. While in the illustrated embodiment only a single CD protuberance forming portion extends substantially continuously in the cross-machine direction, in other embodiments two or more CD protuberance forming portions may extend substantially continuously in the cross-machine direction, such as from two to five CD protuberance forming portions. Similarly the float length and width of the resulting CD protuberance may also vary from the illustrated embodiment. For example, the CD protuberance may have a float length of four or more, such as from four to ten and more preferably from four to eight (measured along its greatest length) and a float width of three or more, such as from three to eight and more preferably from three to six (measured along its greatest width).

Each of the CD protuberance forming portions 45 are woven with a banded stich pattern 50 which may be used to further increase the z-directional displacement of the shute filaments 16 forming the protuberance area 24. With specific reference to the CD protuberance forming portion the shute filament 16*f* (shute position No. 18) has a pair of bands 50 disposed at the shute/warp interchange adjacent to the first proximal end 51*a* and first distal end 53*a*. The bands 50 comprise a first immediately adjacent (in the cross-machine direction) stitch in which the interchange of warp and shute filaments comprises a warp filament 14 above the shute float 16. In the weave pattern illustrated in FIG. 7, the CD protuberance forming portions of shute filaments 16 are banded on all sides, that is to say that for a given CD protuberance forming portion each immediately adjacent shute/warp interchange comprises a warp filament woven above the shute float.

The weave pattern 40 further includes MD protuberance forming portions 43 formed from warp filaments 14. The MD protuberance forming portions 43 generally form discrete MD oriented protuberances 22. Each MD oriented protuberance forming portion of a given warp filament 14 includes a warp float proximal end 55 and a float distal end 56 spaced apart in the machine direction (MD). Looking at a specific warp filament 14*a* (warp position No. 19) within the weave pattern 40 in a top-to-bottom fashion, the float proximal end 55 can be the interchange of a specific shute filament 16 and a specific warp filament 14 that begins a series of adjacent interchanges in which the warp filaments 14 are woven above that specific shute filament 16. The float distal end 56 can be the interchange of a specific shute filament 16 and a specific warp filament 14 that ends a series of adjacent interchanges in which the warp filaments 14 are woven above that specific shute filament 16. In other words, a shute filament 16 float proximal end 55 can be where the shute filament 16 is woven from a web contacting side 20 to the machine contacting side 18 of the fabric 10 and a shute filament 16 float distal end 56 can be where the shute filament is woven from a machine contacting side 18 to the web contacting side 20 of the fabric. Thus, the weave pattern for a specific warp filament between a warp float proximal end and a warp float distal end can be pictured such that a given MD protuberance forming warp filament is woven above each successive shute filament. In other words, a warp filament is woven above each shute filament between the warp float proximal end and the warp float distal end.

The float length of the warp filaments woven above the shute floats to form the MD oriented protuberance may vary. For example, the warp shutes forming the MD oriented protuberance may have a float length from four to twenty, such as from eight to sixteen and more preferably from ten to fourteen.

Further, the MD oriented protuberance may comprise a single warp float woven above successive shute floats between the proximal and distal ends of the protuberance, or it may comprise two or more immediately adjacent warp floats, such as from two to six warp floats, such as from two to four warp floats. Where a MD oriented protuberance comprises two or more warp floats, the float length of that portion of the warp filament woven above the shute floats may be the same or it may be different.

In a particularly preferred embodiment, such as the weave pattern illustrated FIG. 7, a first MD oriented protuberance 22*a* extends in a first longitudinal direction 61 and the next adjacent protuberance MD oriented protuberance 22*b* extends in a longitudinal direction 63 opposite of that of the first MD oriented protuberance 22*a*.

With continued reference to FIG. 7 the weave pattern 40 further comprises banded stitches 50 disposed about the MD oriented protuberances 22. With specific reference to protuberance 22*b* the warp filament 14*b* has a first proximal end 55 and a first distal end 56 and a pair of bands 50 are disposed approximately midway between the ends 55, 56. The bands 50 comprise a pair of immediately adjacent (in the cross-machine direction) stitches in which the interchange of warp and shute filaments comprises a warp filament above the shute float. Additional bands may also be disposed near the ends 55, 56 of the MD forming portion 43 as well, as illustrated in FIG. 7.

With reference now to FIG. 8, the MD and CD oriented protuberances 22, 24 are woven in a pattern 40 to define pockets 26 there between. Generally the weave pattern is such that the pockets 26 are entirely bound by the MD and CD oriented protuberances 22, 24. In a particularly preferred embodiment it is desirable that the MD oriented protuberances, such as protuberances 22*a* and 22*b*, are substantially parallel to one another and spaced apart from one another in the cross-machine direction and that the CD oriented protuberances, such as protuberances 24*a* and 24*b*, are substantially parallel to one another resulting in a pocket 26*a* having a rectilinear shape bounded by the protuberances 22*b*, 22*d*, 24*a*, 24*b*.

With reference now to FIG. 9A, an alternative weave pattern 40 is illustrated. The weave pattern 40 comprises CD and MD oriented protuberances 22, 24 arranged to define pockets 26 there between. Each MD oriented protuberance 22 is formed from three immediately adjacent warp filaments 14*a*-14*c* each woven with interchanges where the warp filament is woven above the corresponding shute filament to provide three protuberance forming portions 43*a*-43*c*. The first and third protuberance forming portions 43*a*, 43*c* have a float length of eight and the second protuberance forming portion 43*b* has a float length of ten. The proximal 55 and distal 56 ends of the protuberance 22*a* occur at interchanges of specific shute filaments 16 and specific warp filaments 14 that ends a series of adjacent interchanges in which the warp filament 14 is woven above the shute filaments. The proximal 55 and distal 56 ends further serve to tie the shute filaments 16 forming the CD oriented protuberances 24 to the underlying fabric. In this manner one of the shute filaments 16*a* forming the CD oriented protuberance 24 has a first proximal end 51 and first distal end 52 which are immediately adjacent to a proximal or distal end of a MD oriented protuberance. The illustrated weave pattern comprises CD oriented protuberances 24 that extend continuously across the pattern 40 in the cross-machine direction and have a float width (measured in the machine direction) of five at its widest point.

Figure 9B:
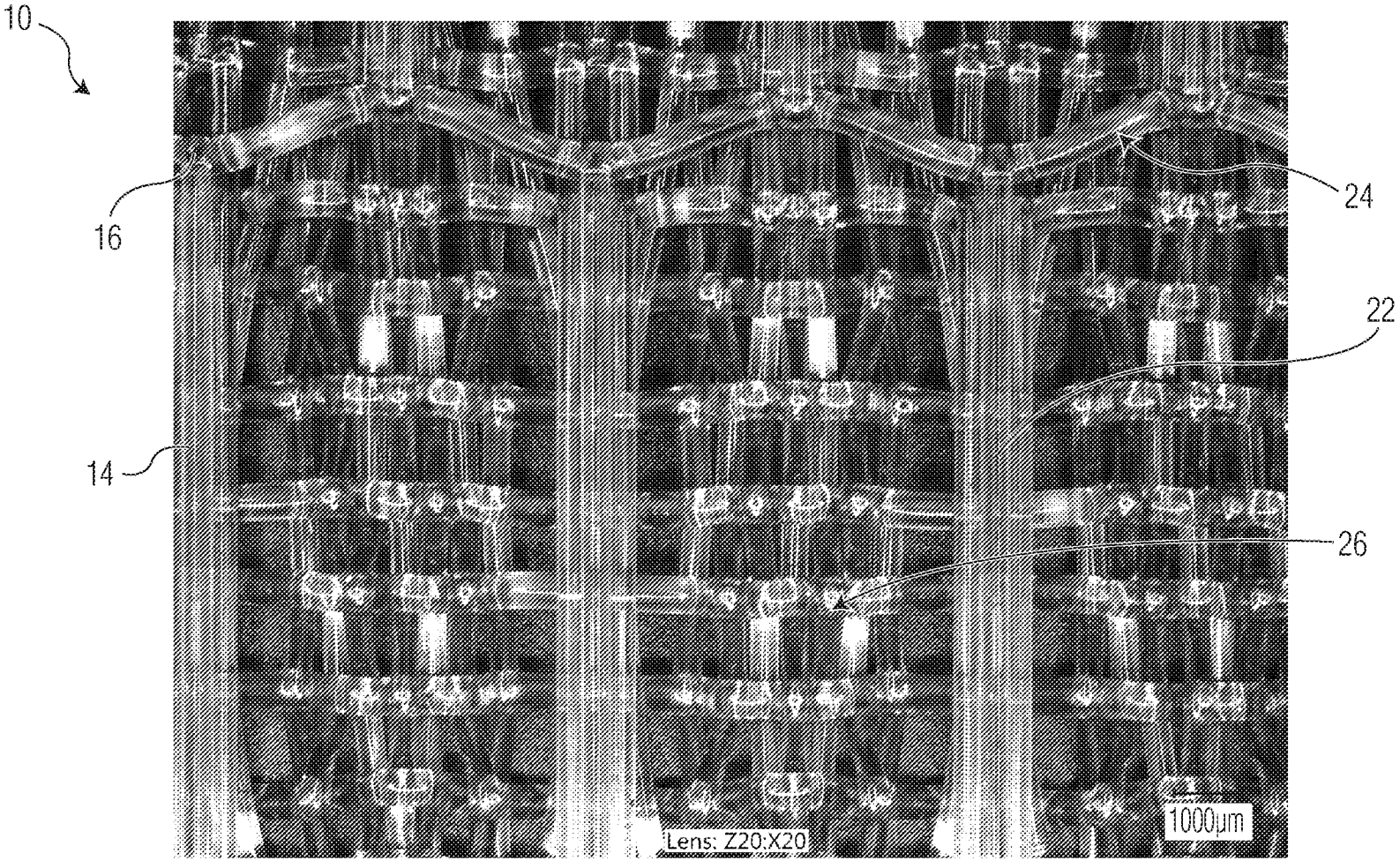
FIG. 9B is a photograph of the web contacting surface of a fabric woven according to the pattern illustrated in FIG. 9A.
Figure 9C:
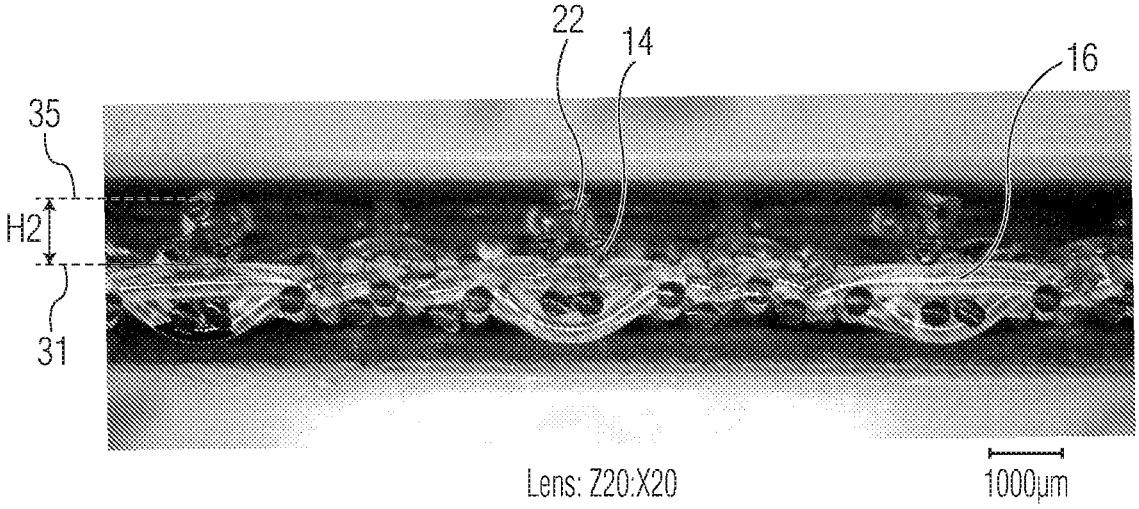
FIG. 9C is a cross-sectional photograph of a fabric woven according to the pattern illustrated in FIG. 9A.
Figure 9D:
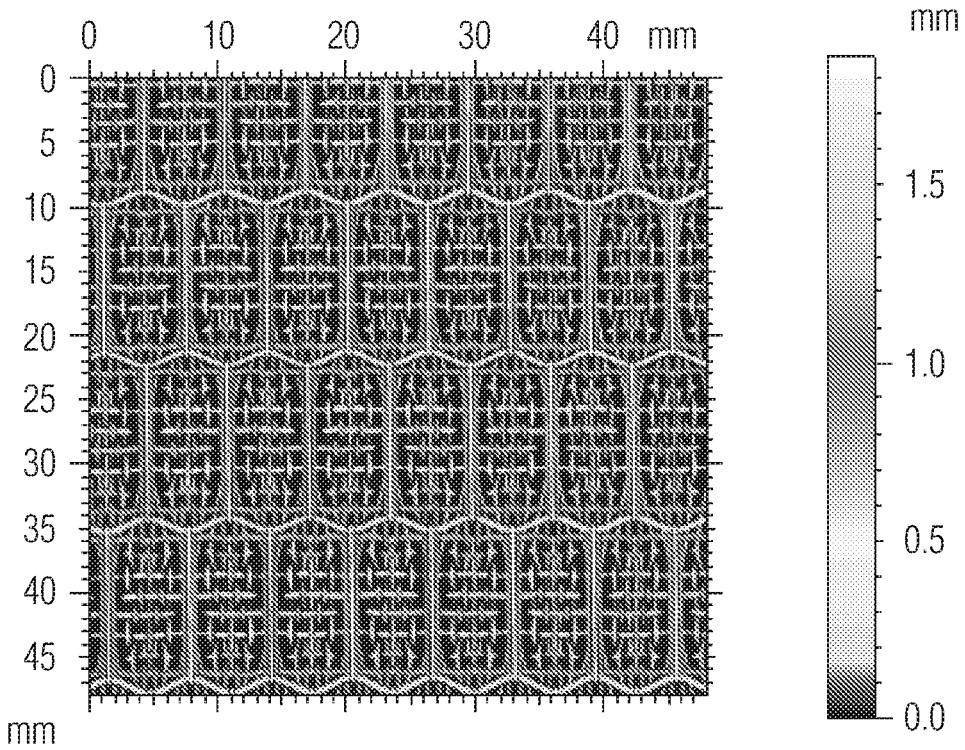
FIG. 9D is a profilometry scan of a fabric woven according to the pattern illustrated in FIG. 9A.

The weave pattern 40 of FIG. 9A generally results in a fabric 10 as shown in FIGS. 9B-D. The MD oriented protuberances 22 are formed from three warp filaments 14 which stack on top of one another (as seen in the cross-sectional image of FIG. 9C) to provide the protuberance 22 with an upper surface plane 35 lying above the pocket plane 31 and height (H1). The use of three warp filaments 14 to form the MD oriented protuberances 22 results in strain being placed on the CD oriented protuberances 24 causing the shute filament 16*a* forming a portion of the protuberance 24 to be displaced. As a result, the pocket 26 has an upper end wall formed by the CD oriented protuberances 24 having two linear segments and the pocket 26 has an overall hexagonal shape, as can be seen in the profilometry scan of FIG. 9D.

Still another weave pattern 40 is illustrated in FIG. 10A. The weave pattern 40 comprises CD and MD oriented protuberances 22, 24 arranged to define pockets 26 there between. Each MD oriented protuberance 22 is formed from three immediately adjacent warp filaments 14 each woven with interchanges where the warp filament is woven above the corresponding shute filament to provide three protuberance forming portions 43. The first and third protuberance forming portion have a float length of eleven and the second protuberance forming portion has a float length of thirteen. The MD oriented protuberances 22 are woven such that a first pair of protuberances 22*a*, 22*b* extend in first machine direction and second pair of protuberances 22*c*, 22*d*, which are immediately adjacent to the first pair 22*a*, 22*b*, extend in a second machine direction which is opposite that of the first. The proximal 55 and distal 56 ends of the protuberance 22 occur at interchanges of specific shute filaments 16 and specific warp filaments 14 that ends a series of adjacent interchanges in which the warp filament 14 is woven above the shute filaments. The proximal 55 and distal 56 ends further serve to tie the shute filaments 16 forming the CD oriented protuberances 24 to the underlying fabric. In this manner a CD protuberance forming portion 45 has a first proximal end 51 and first distal end 52 which are immediately adjacent to a proximal or distal end 55, 56 of a MD oriented protuberance 22. The illustrated weave pattern comprises CD oriented protuberances 24 that extend continuously across the pattern 40 in the cross-machine direction and have a float width (measured in the machine direction) of five at its widest point.

Figure 10B:
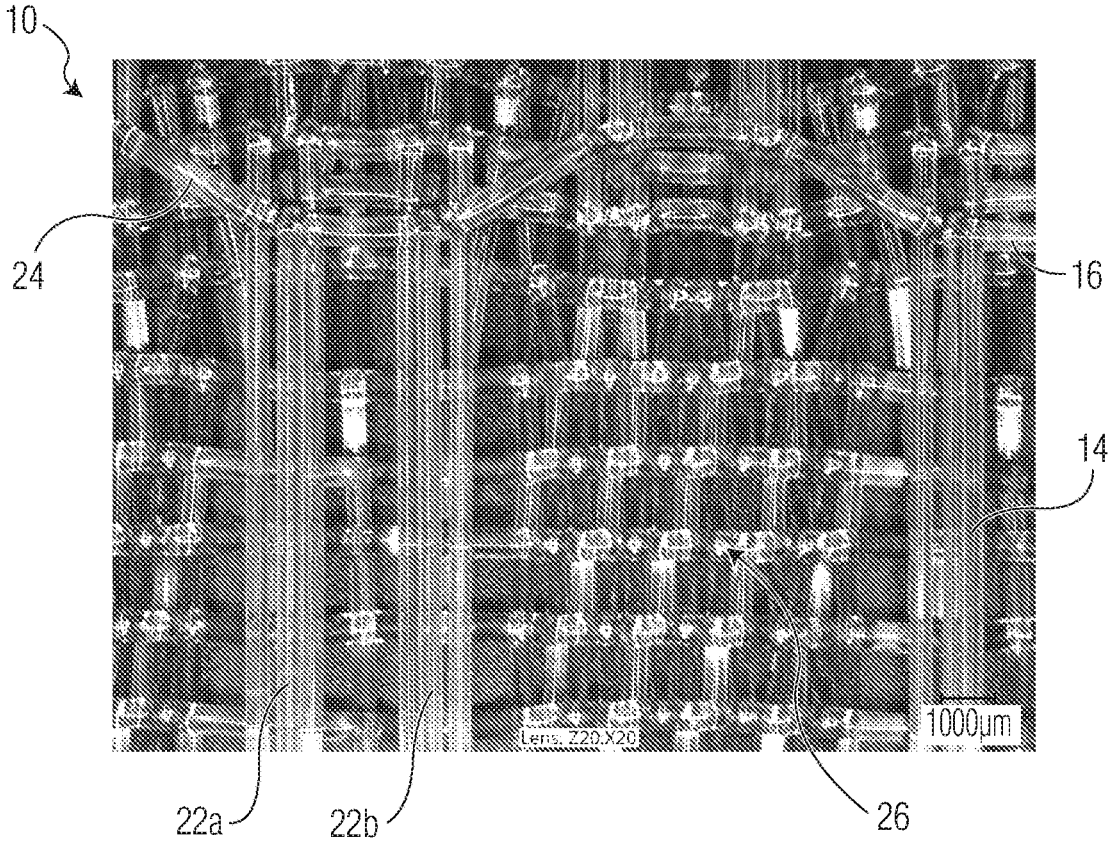
FIG. 10B is a photograph off the web contacting surface of a fabric woven according to the pattern illustrated in FIG. 10A.
Figure 10C:
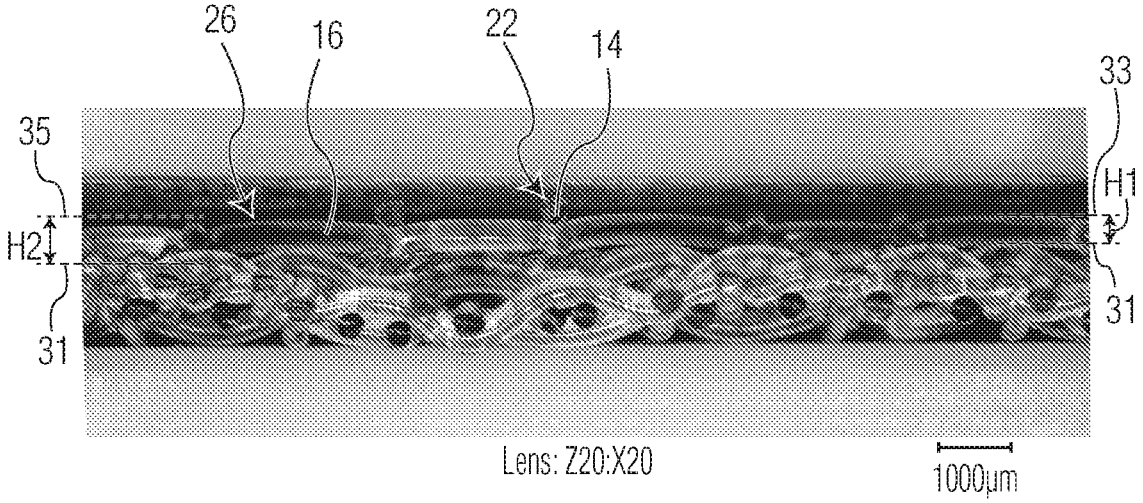
FIG. 10C is a cross-sectional photograph of a fabric woven according to the pattern illustrated in FIG. 10A.
Figure 10D:
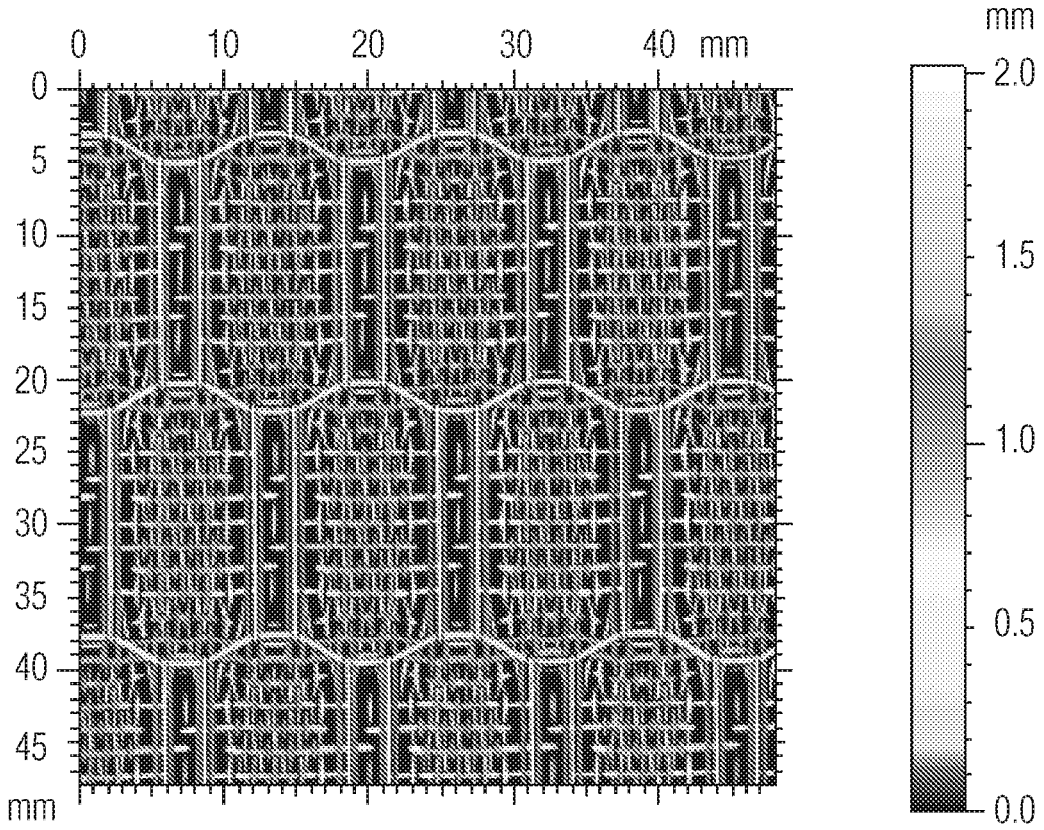
FIG. 10D is a profilometry scan of a fabric woven according to the pattern illustrated in FIG. 10A.

The weave pattern 40 of FIG. 10A generally results in a fabric 10 as shown in FIGS. 10B-D. The CD oriented protuberances 24 are formed from shute filaments 16 which are tied to the underlying fabric intermittently by warp filaments 14 forming the MD oriented protuberances 22 (as seen in the cross-sectional image of FIG. 10C). In this manner the CD oriented protuberance has a height that is above the plane of the pocket formed by the MD and CD protuberances. Further the use of three warp filaments 14 to form the MD oriented protuberances 22 and the arrangement of the protuberances 22*a*, 22*b* and 22*c*, 22*d* in pairwise fashion where the pairs extend in opposite directions results in strain being placed on the CD oriented protuberances 24 causing the shute filament 16*a* forming a portion of the protuberance 24 to be displaced. As a result, the pocket 26 has an upper end wall formed by the CD oriented protuberances 24 having a curvilinear shape and the pocket 26 is not rectilinear, as can be seen in the profilometry scan of FIG. 10D.

Yet another weave pattern 40 is illustrated in FIG. 11A. The weave pattern 40 comprises CD and MD oriented protuberances 22, 24 arranged to define pockets 26 there between. Each MD oriented protuberance 22 is formed from a pair of immediately adjacent warp filaments 14*a*, 14*b* each woven with interchanges where the warp filament is woven above the corresponding shute filament to provide a pair of protuberance forming portions 43*a*, 43*b*. The first protuberance forming portion 43*a* has a float length of nine and the second protuberance forming portion 43*b* has a float length of eight. Both protuberance forming portions 43*a*, 43*b* cross a CD oriented protuberances 24. The CD oriented protuberances 24 is formed from a single shute filament 16 and extends continuously across the pattern 40 in the CD. The pattern 40 generally comprises spaced apart CD oriented protuberances 24 formed from single shute filaments 16*a*, 16*b*, which are spaced apart from one another a distance of four shute filaments. This pattern is repeated to provide a grid-like pattern of pockets 26, which are generally similarly sized and bounded by the CD and MD oriented protuberances 22, 24.

Figure 11B:
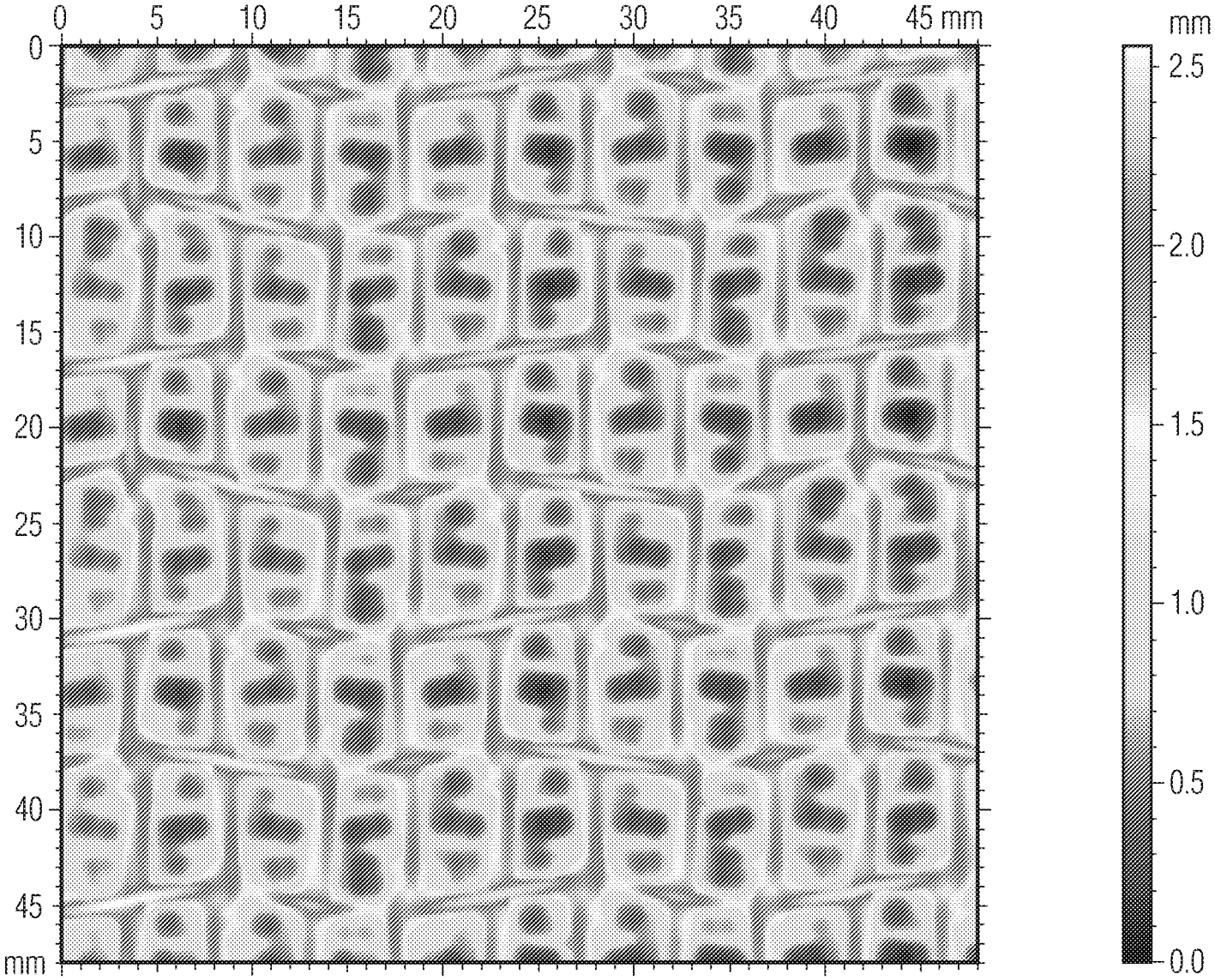
FIG. 11B is a profilometry scan of a fabric woven according to the pattern illustrated in FIG. 11A.

The CD oriented protuberances, are formed from a shute filament extending substantially continuously across the pattern in the CD, and are tied to the underlying fabric intermittently by one of the warp filaments forming the MD oriented protuberances. In this manner the CD oriented protuberance has a height that is above the pocket bottom plane. Further, the height of the CD oriented protuberance is approximately equally to that of the MD oriented protuberances such that the resulting pocket is bound on four sides and was walls having upper surface planes that are generally co-planar with one another, as can be seen in FIG. 11B. The resulting pocket generally has a pocket depth of 1.66 mm and a pocket width of 5.16 mm. The pocket sidewalls, which are formed from the spaced apart MD oriented protuberances, are relatively steep and provide a pocket angle of 41.2 degrees.

With continued reference to FIG. 11B, the use of a single shute filament to form the CD protuberance and the intermittent tying of the filament to the fabric by a warp filament forming the MD oriented protuberances applies strain to the shute filament and causes it to be displaced. As a result, the CD oriented protuberances have a wave-like shape and the resulting pocket has a parallelogram shape.

Still another weave pattern 40 useful in forming a fabric according to the present invention is illustrated in FIG. 12A. The weave pattern 40 comprises CD and MD oriented protuberances 22, 24 arranged to define pockets 26 there between. Each MD oriented protuberance 22 is formed from three immediately adjacent warp filaments 14 each woven with interchanges where the warp filament is woven above the corresponding shute filament to provide three protuberance forming portions 43*a*-43*c*. Each of the protuberance forming portions 43*a*-43*c* have a float length of seven. The protuberance forming portions 43*a*-43*c* generally terminate at a CD oriented protuberances 24. The CD oriented protuberances 24 is formed from a single shute filament 16 and extends continuously across the pattern 40 in the CD. The pattern 40 generally comprises spaced apart CD oriented protuberances 24 formed from single shute filaments 16*a*, 16*b*, which are spaced apart from one another a distance of seven shute filaments. This pattern is repeated to provide a grid-like pattern of pockets 26, which are generally similarly sized and bounded by the CD and MD oriented protuberances 22, 24.

Figure 12B:
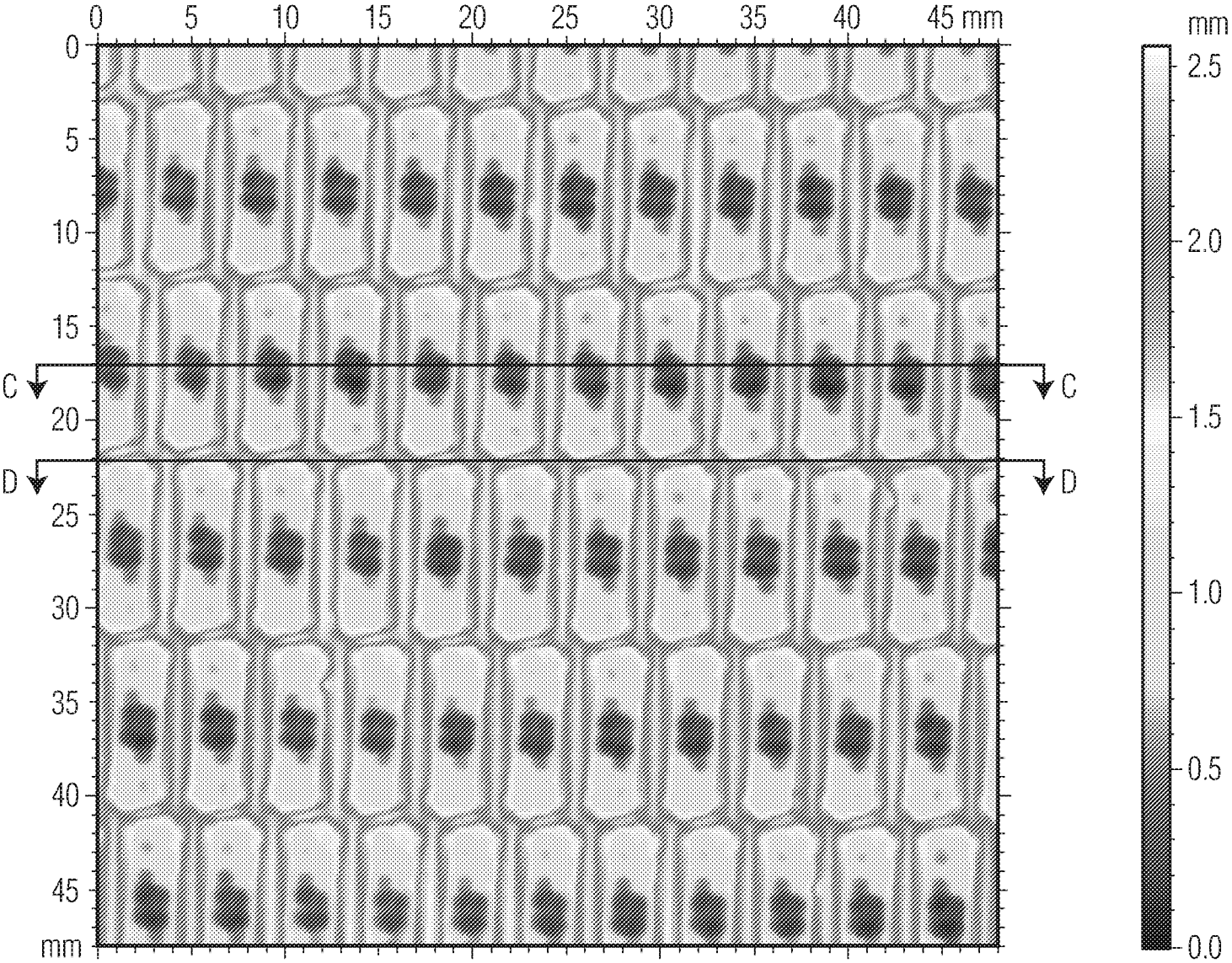
FIG. 12B is a profilometry scan of a fabric woven according to the pattern illustrated in FIG. 12A

The CD oriented protuberances, are formed from a shute filament extending substantially continuously across the pattern in the CD. The MD oriented protuberances are offset from one another in the CD to create a fabric having a staggered grid appearance and pockets that are substantially rectilinear. The CD oriented protuberances have an upper surface plane lying above the pocket bottom plane and are substantially co-planar with the upper surface plane of the MD oriented protuberance, as can be seen in profilometry scan of FIG. 12B.

Figure 12C:
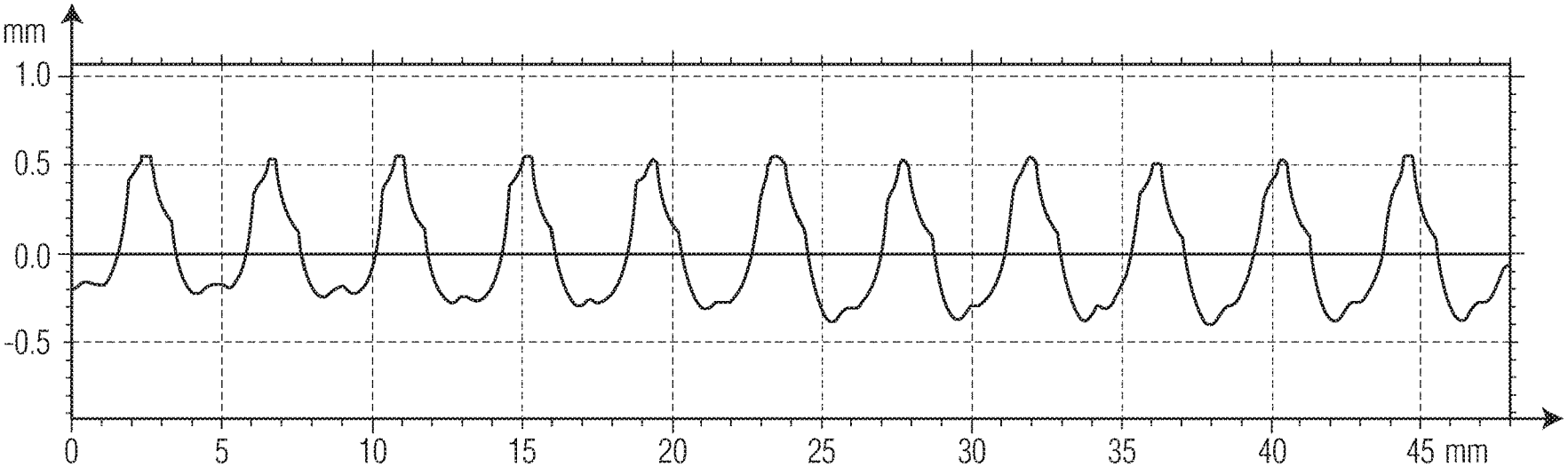
FIG. 12C is a cross-machine direction (CD) profile of the profilometry scan of FIG. 12B along the line C-C.

As illustrated in the MD oriented profile of FIG. 12C the MD oriented protuberances have substantially similar heights and have an upper surface lying in substantially the same plane, which generally defines the upper most surface plane of the fabric. The MD oriented protuberances are spaced apart from one another at regular intervals to provide pockets having a pocket width of 4.21 mm there between. The pockets are relatively deep, having a pocket depth of 1.06 mm. The pocket sidewalls, which are formed from the spaced apart MD oriented protuberances, are relatively steep and provide a pocket angle of 29.5 degrees.

Figure 12D:
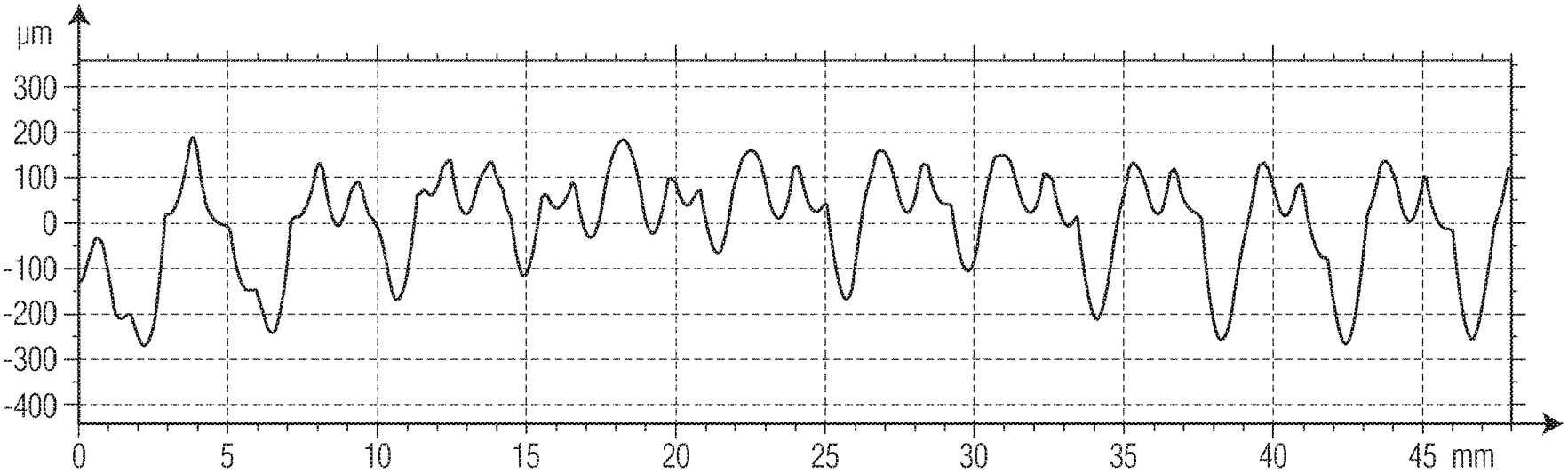
FIG. 12D is a cross-machine direction (CD) profile of the profilometry scan of FIG. 12B along the line D-D.

In the illustrated embodiment the MD and CD oriented protuberances have upper surfaces lying in substantially similar planes. In this manner, the MD and CD oriented protuberances have similar heights and provide pockets with sidewalls that are of similar heights. Further, the upper surface plane formed by the CD oriented protuberances is generally uniform across the CD direction of the fabric, as shown in the profile of FIG. 12D, with slight deviations where the woven filaments forming the MD and CD oriented protuberances intersect.

With reference now to FIG. 13A, which illustrates still another weave pattern 40 useful in forming a fabric according to the present invention, the weave pattern 40 comprises CD and MD oriented protuberances 22, 24 arranged to define pockets 26 there between. Each MD oriented protuberance 22 is formed from three immediately adjacent warp filaments 14*a*-14*c* each woven with interchanges where the warp filament is woven above the corresponding shute filament to provide three protuberance forming portions 43. The first and third protuberance forming portions having a float length of three and the second protuberance forming portion having a float length of five. The protuberance forming portions 43 generally terminate at a CD oriented protuberances 24. The CD oriented protuberances 24 is formed from a single shute filament 16 and extends continuously across the pattern 40 in the CD. The pattern 40 generally comprises spaced apart CD oriented protuberances 24 formed from single shute filaments 16*a*, 16*b*, which are spaced apart from one another a distance of three shute filaments. This pattern is repeated to provide a grid-like pattern of pockets 26, which are generally similarly sized and bounded by the CD and MD oriented protuberances 22, 24.

Figure 13B:
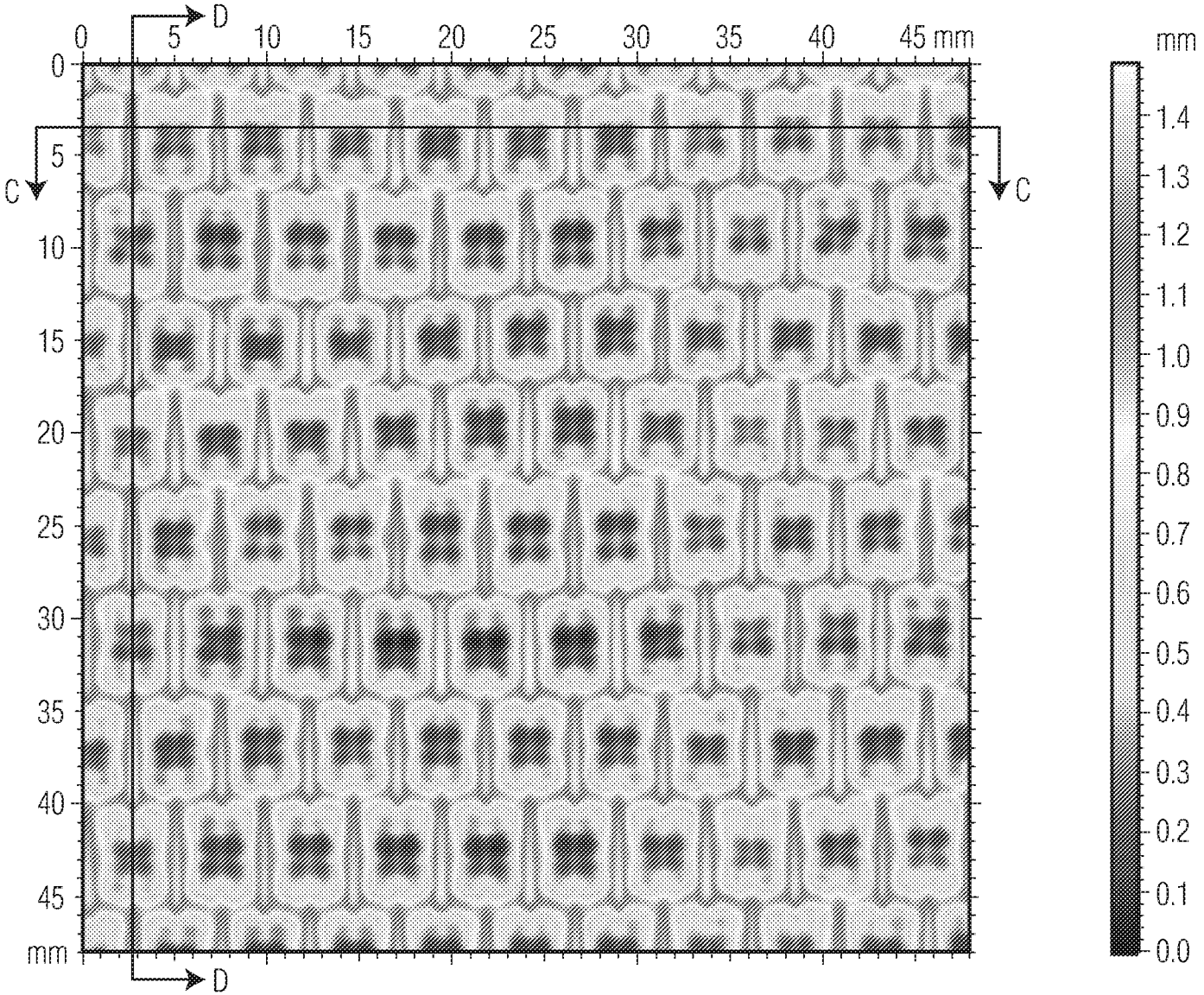
FIG. 13B is a profilometry scan of a fabric woven according to the pattern illustrated in FIG. 13A.
Figure 13C:
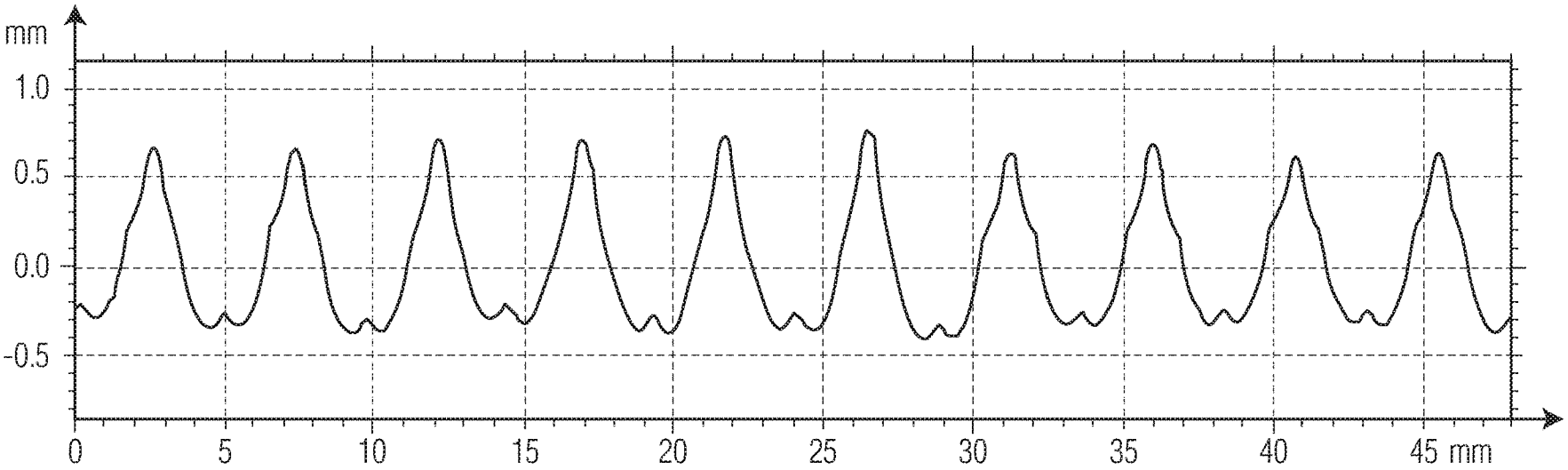
FIG. 13C is a cross-machine direction (CD) profile of the profilometry scan of FIG. 13B along the line C-C.
Figure 13D:
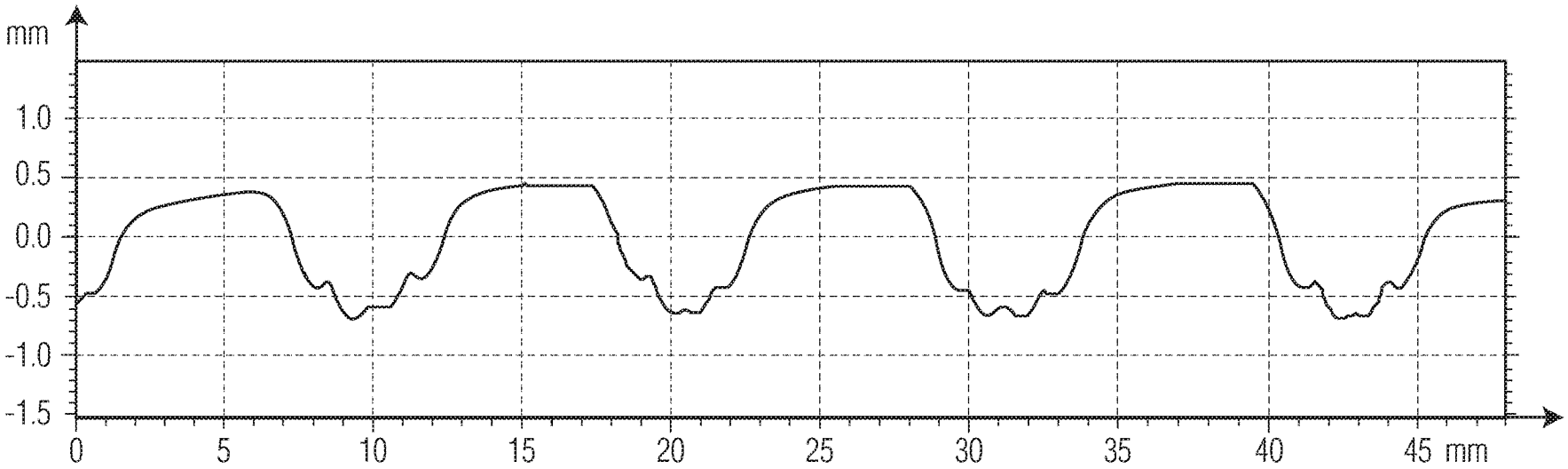
FIG. 13D is a machine direction (MD) profile of the profilometry scan of FIG. 13B along the line D-D.

The pattern of FIG. 13A results in a fabric having pockets that are hexagonal shaped, as shown in the profilometry scan of FIG. 13B and the profiles of FIGS. 13C and 13D. The CD and MD oriented protuberances that form the pocket boundary generally have upper surface planes that are co-planar with one another and provide the pocket with a depth of 1.08 mm. The pocket sidewalls, which are formed from the spaced apart MD oriented protuberances, are spaced apart to provide a pocket width of 4.40 mm, are relatively steep and provide a pocket angle of 29.1 degrees.

Test Method

The pocket depth and pocket angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μ|η spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

Based upon the foregoing, three values, indicative of the fabric topography are reported—pocket depth, pocket width and pocket angle. Pocket width is the Psm value, having units of millimeters (mm). Pocket depth is the difference between C2 and C1 values, having units of millimeters (mm). In certain instances pocket depth may be referred to as S90. Pocket angle is the Pdq value, having units of degrees (°).

Embodiments

The scope of the present invention should be assessed as that of the appended claims and any equivalents thereto and the following embodiments:

In a first embodiment the present invention provides a woven papermaking fabric comprising: a plurality of substantially machine direction (MD) oriented warp filaments; and a plurality of substantially cross-machine direction (CD) oriented shute filaments, the shute filaments being interwoven with warp filaments to provide a woven fabric having a textured web contacting side and an opposite machine contacting side having a plurality of discrete pockets disposed thereon, wherein each discrete pocket has a pair of opposed end walls and a pair of opposed sidewalls, wherein the opposed end walls comprise at least one shute filament and the sidewalls comprise at least one warp filament.

In a second embodiment the present invention provides the woven papermaking fabric of the first embodiment wherein each pocket has a pocket bottom lying in a pocket bottom plane, the shute filament forming the opposed end walls has an upper surface plane defining a second surface plane and the warp filament forming the opposed sidewalls has an upper surface plane defining a third surface plane, wherein the second and third surface planes lie above the pocket bottom plane.

In a third embodiment the present invention provides the woven papermaking fabric of the first or second embodiment wherein the pocket has a pocket depth of at least about 1.0 mm.

In a fourth embodiment the present invention provides the woven papermaking fabric of any one of the foregoing embodiments having a third surface plane lies above the second surface plane.

In a fifth embodiment the present invention provides the woven papermaking fabric of any one of the foregoing embodiments having second and third surface planes that are substantially co-planar.

In a sixth embodiment the present invention provides the woven papermaking fabric of any one of the foregoing embodiments wherein the pocket depth is from about 0.2 to about 1.5 mm.

In a seventh embodiment the present invention provides the woven papermaking fabric of any one of the foregoing embodiments having a pocket width from about 3.0 to about 5.0 mm.

In an eighth embodiment the present invention provides the woven papermaking fabric of any one of the foregoing embodiments having a pocket angle of about 28 degrees or greater.

In a ninth embodiment the present invention provides the woven papermaking fabric of any one of the foregoing embodiments wherein the opposed pocket end walls are spaced apart from one another in the CD from about 5.0 to about 20.0 mm.

In a tenth embodiment the present invention provides the woven papermaking fabric of any one of the foregoing embodiments wherein each of the opposed pocket end walls comprise a single continuous shute filament.

In an eleventh embodiment the present invention provides the woven papermaking fabric of any one of the foregoing embodiments wherein each of the pockets are substantially the same shape and the shape is selected from the group consisting of a square, a rectangle, an octagon, a parallelogram and a rhombus.

In a twelfth embodiment the present invention provides the woven papermaking fabric of any one of the foregoing embodiments wherein each of the discrete pockets have a pocket area from about 100 to about 300 $mm^2$.

In a thirteenth embodiment the present invention provides the woven papermaking fabric of any one of the foregoing embodiments wherein the sidewalls comprise a plurality of warp filaments.

What is claimed is:

1. A woven papermaking fabric comprising: a plurality of substantially machine direction (MD) oriented warp filaments; and a plurality of substantially cross-machine direction (CD) oriented shute filaments, the shute filaments being interwoven with warp filaments to provide a woven fabric having a textured web contacting side and an opposite machine contacting side having a plurality of discrete pockets disposed thereon, wherein each discrete pocket has a pair of opposed end walls and a pair of opposed sidewalls, wherein the opposed end walls comprise a plurality of stacked shute filaments and the sidewalls comprise a plurality of stacked warp filaments wherein each pocket has a pocket bottom lying in a pocket bottom plane, the shute filament forming the opposed end walls has an upper surface plane defining a second surface plane and the warp filament forming the opposed sidewalls has an upper surface plane defining a third surface plane, wherein the second and third surface planes lie above the pocket bottom plane; and wherein the fabric has a pocket depth of at least about 1.0 mm.

2. The woven papermaking fabric of claim 1 wherein third surface plane lies above the second surface plane.

3. The woven papermaking fabric of claim 1 wherein the second and third surface planes are substantially co-planar.

4. The woven papermaking fabric of claim 1 wherein the z-direction height difference between the pocket bottom plane and the second surface plane is from about 0.2 to about 1.5 mm.

5. The woven papermaking fabric of claim 1 wherein the z-direction height difference between the pocket bottom plane and the third surface plane is from about 0.5 to about 2.0 mm.

6. The woven papermaking fabric of claim 1 wherein the opposed sidewalls are spaced apart from one another in the MD and the pocket width is from about 3.0 to about 5.0 mm.

7. The woven papermaking fabric of claim 1 having a pocket angle of about 28 degrees or greater.

8. The woven papermaking fabric of claim 1 wherein the opposed end walls are spaced apart from one another in the CD from about 5.0 to about 20.0 mm.

9. The woven papermaking fabric of claim 1 wherein each of the opposed end walls comprises a single continuous shute filament.

10. The woven papermaking fabric of claim 1 wherein each of the discrete pockets are substantially the same shape and the shape is selected from the group consisting of a square, a rectangle, an octagon, a parallelogram and a rhombus.

11. The woven papermaking fabric of claim 1 wherein each of the discrete pockets have substantially similar pocket depths and pocket widths.

12. The woven papermaking fabric of claim 1 wherein each of the discrete pockets have a pocket area from about 100 to about 300 $mm^2$.

13. The woven papermaking fabric of claim 1 wherein each of the discrete pockets have a pocket volume from about 10 to about 200 $mm^3$.

14. A woven papermaking fabric comprising a plurality of substantially machine direction (MD) oriented warp filaments; and a plurality of substantially cross-machine direction (CD) oriented shute filaments, the shute filaments being interwoven with warp filaments to provide a textured web contacting side of the woven papermaking fabric and machine contacting side of the woven papermaking fabric, wherein the web contacting side comprises: a substantially CD oriented protuberance comprising at least one shute filament woven above a corresponding warp filament, the shute filament having a first proximal end and a first distal end, the at least one shute filament; a first substantially MD oriented protuberance comprising a warp filament extending in a first longitudinal direction and woven above a corresponding shute filament, the first MD oriented protuberance having a first proximal end disposed adjacent to the first proximal end of the at least one shute element, and a second substantially MD oriented protuberance comprising a warp filament extending in a second longitudinal direction opposite that of the first substantially MD oriented protuberance and woven above a corresponding shute filament, the second MD oriented protuberance having a first distal end disposed adjacent to the first distal end of the at least one shute element;

wherein the fabric comprises a pocket a pair of opposed end walls and a pair of opposed sidewalls, wherein the opposed end walls comprise a plurality of stacked shute filaments and the sidewalls comprise a plurality of stacked warp filaments and wherein the pocket has a pocket depth of at least about 1.0 mm.

15. The woven papermaking fabric of claim 14 wherein the CD oriented protuberance forms a portion of a pocket end wall and the first MD oriented protuberance forms a portion of a pocket sidewall, the pocket having a pocket bottom lying in a first fabric plane.

16. The woven papermaking fabric of claim 15 wherein the CD oriented protuberance lies in a second fabric plane and the first MD oriented protuberance lies in a third fabric plane, wherein the second fabric plane lies above the first fabric plane and the third fabric plane lies above the second fabric plane.

17. The woven papermaking fabric of claim 15 wherein the CD oriented protuberance lies in a second fabric plane and the first MD oriented protuberance lies in a third fabric plane, wherein the second and third fabric planes are substantially co-planar and lie above the first fabric plane.

18. The woven papermaking fabric of claim 15 further comprising a third substantially MD oriented protuberance comprising a warp filament, the first and third substantially MD oriented protuberances forming opposed sidewalls of a pocket, the pocket having a pocket width from about 3.0 to about 5.0 mm.

19. The woven papermaking fabric of claim 15 further comprising a second substantially CD oriented protuberance, the first and second substantially CD oriented protuberances forming opposed endwalls of a pocket.

20. The woven papermaking fabric of claim 15 wherein the substantially MD oriented protuberance comprises two or more warp filaments woven above their corresponding shute filaments.

21. A woven papermaking fabric comprising: a plurality of substantially machine direction (MD) oriented warp filaments; and a plurality of substantially cross-machine direction (CD) oriented shute filaments, the shute filaments being interwoven with warp filaments to provide a woven fabric having a textured web contacting side and an opposite machine contacting side having a plurality of discrete rectilinear pockets having a pocket depth from about 1.0 to about 2.0 mm and a pocket angle from about 28 to about 40 degrees, thereon, the pocket having a first sidewall formed from a plurality of stacked shute filaments, and a second sidewall formed from a plurality of stacked warp filaments, wherein the first and second sidewalls have upper surfaces that are substantially co-planar.

22. The woven papermaking fabric of claim 21 wherein each of the plurality of discrete pockets are substantially the same shape and the shape is selected from the group consisting of a square, a rectangle, an octagon, a parallelogram and a rhombus.

23. The woven papermaking fabric of claim 21 wherein each of the plurality of discrete pockets have substantially similar pocket depths and pocket widths.

* * * * *